US007868843B2

(12) United States Patent
Borau et al.

(10) Patent No.: US 7,868,843 B2
(45) Date of Patent: Jan. 11, 2011

(54) SLIM MULTI-BAND ANTENNA ARRAY FOR CELLULAR BASE STATIONS

(75) Inventors: Carmen Maria Borja Borau, Barcelona (ES); James Dillion Kirchhofer, Sant Cugat del Valles (ES); Anthony Teillet, Sant Cugat del Valles (ES); Carles Puente Baliarda, Barcelona (ES)

(73) Assignee: Fractus, S.A., Barcelona (ES)

( * ) Notice: Subject to any disclaimer, the term of this patent is extended or adjusted under 35 U.S.C. 154(b) by 721 days.

(21) Appl. No.: 11/660,802

(22) PCT Filed: Aug. 31, 2005

(86) PCT No.: PCT/EP2005/009376

§ 371 (c)(1),
(2), (4) Date: Jun. 7, 2007

(87) PCT Pub. No.: WO2006/024516

PCT Pub. Date: Mar. 9, 2006

(65) Prior Publication Data

US 2008/0062062 A1 Mar. 13, 2008

Related U.S. Application Data

(60) Provisional application No. 60/606,038, filed on Aug. 31, 2004, provisional application No. 60/678,569, filed on May 6, 2005.

(30) Foreign Application Priority Data

Apr. 21, 2005 (EP) ..... 05103226

(51) Int. Cl.
*H01Q 21/00* (2006.01)

(52) U.S. Cl. ..... 343/844; 343/700 MS; 343/797

(58) Field of Classification Search ..... 343/700 MS, 343/844, 797, 874, 875, 880
See application file for complete search history.

(56) References Cited

U.S. PATENT DOCUMENTS 3,605,102 A 9/1971 Frye (Continued)

FOREIGN PATENT DOCUMENTS

EP 0688040 A2 12/1995

(Continued)

OTHER PUBLICATIONS

Kim et al, The fractal random array, IEEE Proceedings, Sep. 1986.

(Continued)

*Primary Examiner*—Douglas W Owens
*Assistant Examiner*—Dieu Hien T Duong
(74) *Attorney, Agent, or Firm*—Winstead PC

(57) ABSTRACT

This invention is in the field of base station antennas for wireless communications. The present invention refers to a slim multi-band antenna array for cellular base stations, which provides a reduced width of the base station antenna and minimizes the environmental and visual impact of a network of cellular base station antennas, in particular in mobile telephony and wireless service networks. A multiband antenna array comprises a first set of radiating elements operating at a first frequency band and a second set of radiating elements operating at a second frequency band, said radiating elements being smaller than λ/2 or smaller than λ/3, being (λ) the longest operating wavelength. The ratio between the largest and the smaller of said frequency bands is smaller than 2.

42 Claims, 15 Drawing Sheets

U.S. PATENT DOCUMENTS

| | | | | |
|---|---|---|---|---|
| 3,818,490 | A | 6/1974 | Leahy | |
| 3,969,730 | A | 7/1976 | Fuchser | |
| 4,243,990 | A | 1/1981 | Nemit et al. | |
| 4,623,894 | A | 11/1986 | Lee et al. | |
| 4,912,481 | A | 3/1990 | Mace et al. | |
| 5,210,542 | A | 5/1993 | Pett et al. | |
| 5,220,335 | A | 6/1993 | Huang | |
| 5,227,808 | A | 7/1993 | Davis | |
| 5,307,075 | A | 4/1994 | Huynh | |
| 5,394,163 | A | 2/1995 | Bullen et al. | |
| 5,497,164 | A | 3/1996 | Croq | |
| 5,512,914 | A | 4/1996 | Hadzoglou et al. | |
| 5,537,367 | A | 7/1996 | Lockwood et al. | |
| 5,767,814 | A | 6/1998 | Conroy et al. | |
| 5,861,845 | A | 1/1999 | Lee et al. | |
| 5,903,822 | A | 5/1999 | Sekine | |
| 5,969,689 | A | 10/1999 | Martek et al. | |
| 6,025,812 | A | 2/2000 | Gabriel et al. | |
| 6,046,706 | A * | 4/2000 | Vargas | 343/883 |
| 6,075,485 | A | 6/2000 | Lilly et al. | |
| 6,091,365 | A | 7/2000 | Derneryd et al. | |
| 6,118,406 | A | 9/2000 | Josypenko | |
| 6,133,882 | A | 10/2000 | LaFleur et al. | |
| 6,154,180 | A | 11/2000 | Padrick | |
| 6,175,333 | B1 | 1/2001 | Smith et al. | |
| 6,211,824 | B1 | 4/2001 | Holden et al. | |
| 6,211,841 | B1 | 4/2001 | Smith et al. | |
| 6,239,762 | B1 | 5/2001 | Lier | |
| 6,307,519 | B1 | 10/2001 | Livingston et al. | |
| 6,333,720 | B1 | 12/2001 | Gottl et al. | |
| 6,362,790 | B1 | 3/2002 | Proctor, Jr. et al. | |
| 6,377,217 | B1 | 4/2002 | Zhu et al. | |
| 6,388,620 | B1 | 5/2002 | Bhattacharyya | |
| 6,421,024 | B1 | 7/2002 | Stolle | |
| 6,452,549 | B1 | 9/2002 | Lo | |
| 6,462,710 | B1 | 10/2002 | Carson et al. | |
| 6,480,168 | B1 | 11/2002 | Lam et al. | |
| 6,489,925 | B2 | 12/2002 | Thursby et al. | |
| 6,525,691 | B2 | 2/2003 | Varadan et al. | |
| 6,538,603 | B1 | 3/2003 | Chen et al. | |
| 6,552,687 | B1 | 4/2003 | Rawnick et al. | |
| 6,597,327 | B2 | 7/2003 | Kanamaluru et al. | |
| 6,611,237 | B2 | 8/2003 | Smith | |
| 6,741,210 | B2 | 5/2004 | Brachat et al. | |
| 6,762,719 | B2 | 7/2004 | Subotic et al. | |
| 6,771,221 | B2 | 8/2004 | Rawnick et al. | |
| 6,774,844 | B2 | 8/2004 | Subotic et al. | |
| 6,819,300 | B2 | 11/2004 | Göttl | |
| 6,911,939 | B2 | 6/2005 | Carson et al. | |
| 6,937,191 | B2 | 8/2005 | Puente Baliarda | |
| 6,943,732 | B2 | 9/2005 | Göttl | |
| 7,053,852 | B2 | 5/2006 | Timofeev et al. | |
| 7,196,674 | B2 | 3/2007 | Timofeev et al. | |
| 2002/0171601 | A1 * | 11/2002 | Puente Baliarda | 343/893 |
| 2003/0011529 | A1 | 1/2003 | Göttl | |
| 2003/0137456 | A1 | 7/2003 | Sreenivas et al. | |
| 2004/0108956 | A1 | 6/2004 | Gottl et al. | |
| 2004/0119645 | A1 | 6/2004 | Lee et al. | |
| 2004/0155820 | A1 | 8/2004 | Sreenivas | |
| 2004/0155831 | A1 | 8/2004 | Goebel et al. | |
| 2004/0201537 | A1 | 10/2004 | Stolle et al. | |
| 2004/0201543 | A1 | 10/2004 | Gottl | |
| 2004/0203284 | A1 | 10/2004 | Stolle et al. | |
| 2004/0257292 | A1 | 12/2004 | Wang | |
| 2005/0001778 | A1 | 1/2005 | Le et al. | |
| 2005/0057417 | A1 | 3/2005 | Teillet et al. | |
| 2005/0134512 | A1 | 6/2005 | Gottl et al. | |
| 2005/0225498 | A1 | 10/2005 | Koparan | |
| 2005/0264463 | A1 | 12/2005 | Gottl et al. | |
| 2006/0114168 | A1 | 6/2006 | Gottl et al. | |
| 2006/0176235 | A1 | 8/2006 | Gottl et al. | |

FOREIGN PATENT DOCUMENTS

| | | | |
|---|---|---|---|
| EP | 0817310 | A2 | 1/1998 |
| EP | 1223637 | B1 | 9/1999 |
| EP | 1071161 | A1 | 1/2001 |
| EP | 1168493 | A2 | 6/2001 |
| EP | 1168493 | A2 | 1/2002 |
| EP | 1223637 | B1 | 7/2002 |
| EP | 1227545 | A1 | 7/2002 |
| EP | 1320146 | A1 | 6/2003 |
| EP | 0843905 | B1 | 12/2004 |
| EP | 1223637 | B1 | 3/2005 |
| ES | 1058218 | U | 11/2004 |
| FR | 2704359 | A1 | 10/1994 |
| GB | 2161026 | A | 1/1986 |
| GB | 2424765 | | 10/2006 |
| GB | 2424765 | A1 | 10/2006 |
| JP | 10209749 | | 8/1998 |
| WO | 95/05012 | A1 | 2/1995 |
| WO | 97/35360 | A1 | 9/1997 |
| WO | 9821779 | A1 | 5/1998 |
| WO | 99/59223 | A2 | 11/1999 |
| WO | WO-00/46872 | | 8/2000 |
| WO | 00/52787 | A1 | 9/2000 |
| WO | 00/55939 | A1 | 9/2000 |
| WO | 0055939 | A1 | 10/2000 |
| WO | 01/54225 | A1 | 7/2001 |
| WO | 0154225 | A1 | 7/2001 |
| WO | 02/23669 | A1 | 3/2002 |
| WO | 0223669 | A1 | 3/2002 |
| WO | 02/084790 | A1 | 10/2002 |
| WO | WO 02084790 | A1 * | 10/2002 |
| WO | 02/091518 | A1 | 11/2002 |
| WO | 02/095874 | A1 | 11/2002 |
| WO | 02/096166 | A1 | 11/2002 |
| WO | 03/023900 | A1 | 3/2003 |
| WO | WO 03036759 | A1 * | 5/2003 |
| WO | 03/083992 | A1 | 10/2003 |
| WO | 03083992 | A1 | 10/2003 |
| WO | 2004/010535 | A1 | 1/2004 |
| WO | 2004010535 | A1 | 1/2004 |
| WO | 2004055938 | A2 | 7/2004 |
| WO | 00/46872 | A1 | 8/2004 |
| WO | 2005122331 | A1 | 12/2005 |
| WO | 2006024516 | A1 | 3/2006 |
| WO | 2007011295 | A1 | 1/2007 |

OTHER PUBLICATIONS

Parker et al, Convoluted array elements and reduced size unit cells for frequency-selective surfaces, IEE Proceedings H, Feb. 1991.

Mayes, Frequency independent antennas and broad-band derivatives thereof, IEEE Proceedings, Jan. 1992.

Puente et al, Multiband fractal antennas and arrays, Fractals engineering, Sep. 1994.

Chu et al, Analysis and design of a multi-band phased array using multi-feed dipole elements, Antennas and propagation society international symposium 1995 AP-S, Jun. 1995.

Puente et al, Fractal design of multiband and low side-lobe arrays, IEEE Transaction on antennas and propagation, May 1996.

Chu et al, Multiband phased-array antenna with interleaved tapered-elements and waveguide radiators, Antennas and propagation society international symposium. AP-S Digest, Jul. 1996.

Puente, Fractal antennas (Ph.D. Dissertation), Universitat Politecnica de Catalunya, May 1997.

Lindmark et al, Dual polarised multibeam antenna, Electronic letters, Dec. 1999.

Gianvittorio et al, Fractal loop elements in phased array antennas: reduced mutual coupling and tighter packing, International conference on Phased Array Systems and Technology, Jan. 2000.

Kim et al, A study of wideband dual-frequency dual-polarization microstrip array antenna, IEEE Antennas and Propagation Society International Symposium, Jul. 2000.
Gianvittorio et al, Fractal elements in array antennas: investigating reduced mutual coupling and tighter packing, Antennas and propagation society international symposium, Jul. 2000.
Kim et al, Dual-feeding microstrip antenna with high isolation, Microwave and Optical Technology Letters, Oct. 2002.
Ramirez et al, A mutual coupling study of linear and circular polarized microstrip antennas for diversity wireless systems, IEEE Transactions on antennas and propagation, Feb. 2003.
Anguera, Fractal and broadband techniques on miniature, multifrequency, and high-directivity microstrip patch antennas (Ph.D Dissertation), Universitat Politecnica de Catalunya, May 2003.
SEO et al, Novel active array antenna using a transmission-line coupling network and a voltage-controlled oscillator with a varactor diode, Microwave and optical technology letters, May 2001.
Wong, Planar antennas for wireless communications, Wiley Interscience, 2003.
Izadian , Jamal S. Base-station antennas offer dual polarization. Microwaves & RF, May 2002.
Armogida , A. Microstrip patch antenna array for a mobile communication system base station. Microwave Conference Proceedings, 1997. APMC '97, 1997.
Chan , T. A dual-band microstrip array antenna. Antennas and Propagation Society International Symposium, 1995.
Borja, C., Fractal microstrip patch antennas with fractal perimeter and self-affine properties [Ph. D. Dissertation]. Universitat Politècnica de Catalunya, May 2001.
Lu, J. H. Broadband dual-frequency operation of circular patch antennas and arrays with a pair of L-shaped slots. IEEE Transactions on Antennas and Propagation, vol. 51, May 2003.
Poularikas, A. Handbook of antennas in wireless communications, CRC Press, cop. 2002.
Chan, T. ; Hwang, Y. A dual-band microstrip array antennas. Antennas and Propagation Society International Symposium, 1995.
Anguera, J., Fractal and broadband techniques on miniature, multifrequency and high-directivity microstrip patch antennas, Ph. D. Dissertation, Universitat Politécnica de Catalunya, May 2003.
Borja, C., Fractal microstrip patch antennas with fractal perimeter and self-affine properties, Ph. D. Dissertation, Universitat Politécnica de Catalunya, May 2001.
Hienonen, S., Studies on microwave antennas: passive intermodulation distortation in antenna structures and design of microstrip antenna elements, Ph. D. Dissertation, Helsinki University of Technology Laboratory Publications, Mar. 2005.
Voipio, V., Dual band dual polarized basestation antenna FDTD design study, IEEE , Feb. 2007.
Lu, J. H., Broadband dual-frequency operation of circular patch antennas and arrays with a pair of L-shaped slot, IEEE Transactions on Antennas and Propagation, May 2003, vol. 51, No. 5.
Voipio , V. Triple band dual polarized basestation antenna, IEEE, May 2007.
Suarez, C. A., Design of basic element in a circulary grouping for stations bases GSM-UMTS / Diseño del elemento basico en una agrupación circular para estaciones base GSM-UMTS, XXI Simposium Nacional de la Unión Cientifica Internacional de Radio, Set. 2006.
Poularikas, A., Chapter 11. Outdoor and indoor cellular/personal handy phone system base station antenna in Japan, Handbook of antennas in wireless communications, CRC Press, 2002.
Jones, H. S. Conformal and Small antenna designs. Proceedings of the Antennas Applications Symposium, 1981.
Puente, C., et al., "Diseño Fractal de Agrupaciones de Antenas", Departamento de Teoria de la Señal y Communications, E.T.S.I. Telecommunicatión, Universitat Politè cnica de Catalunya, Apdo. Postal 30002 08080 Barcelona, Tel 93-4016849.

* cited by examiner

SLIM MULTI-BAND ANTENNA ARRAY FOR CELLULAR BASE STATIONS

This patent application claims the benefit of priority from U.S. Provisional Patent Application Ser. No. 60/606,038 filed on Aug. 31, 2004, and U.S. Provisional Patent Application Ser. No. 60/678,569 filed on May 6, 2005. This application incorporates by reference the entire disclosure of U.S. Provisional Patent Application Ser. No. 60/606,038 and 60/678,569.

OBJECT OF THE INVENTION

The present invention refers to a slim multi-band antenna array for cellular base stations, which provides a reduced width of the base station antenna and minimizes the environmental and visual impact of a network of cellular base station antennas, in particular in mobile telephony and wireless service networks. The invention relates to a generation of slim base station sites that are able to integrate multiple mobile/cellular services into a compact radiating system.

A Multi Band antenna array of the invention comprises an interlaced arrangement of small radiating elements to significantly reduce the size of the antenna. More specifically the width of this antenna being similar to the width of a typical single band antenna so about half of the width of typical Dual Band antenna.

BACKGROUND OF THE INVENTION

The UMTS, third generation of wireless communications systems, that is being added to $2^{nd}$ generation of wireless communications systems (such as GSM900, DCS, PCS1900, CDMA, TDMA) has created a demand for multiband antennas and in particular to Dual Band Base Station Antennas. The typical Dual band antennas that are used today are side by side arrays where the size is typically twice of the size of a single band antenna. To be more specific the typical width of Dual Band antenna is around 2 wavelengths, which is about 30 cm in the case of an antenna operating at two of the following communication services DCS, PCS or UMTS while the width of a Single Band antenna is typically around one wavelength, which is around 15 cm in case of a DCS, PCS or UMTS antenna.

The cellular services require several Base Stations that are composed by several base station antennas to give service to the cellular users. The antennas are the radiating part of the Base Station. Typically, the radiating part of the Base Station is composed by nine or three independent antennas that give coverage to a specific part of the city, village, road, motorway. As the radiating part of the Base Station is composed by several antennas, the size of the Base Station is large and has a significant visual impact.

The visual impact due to the size and number of antennas at the Base Station has been a rising issue for operators and consumers, so creating a demand for smaller antennas, having less visual impact, but still maintaining the same performance and functionality. Governments desire to minimize the visual impact of the Base Station, and it is becoming very difficult for the operators to get a license to set up new Base Stations on the cities and villages around the world.

Adjustable electrical down-tilt techniques for antenna systems are very well known in the related background art.

SUMMARY OF THE INVENTION

The invention provides tools and means to minimize the visual impact and cost of mobile telecommunication networks while at the same time simplifying the logistics of the deployment, installation and maintenance of such networks. The invention provides a slim base station site which integrates multiple mobile/cellular services into a compact radiating system. The radiating system includes an adjustable electrical tilt system for one or more of the operating frequency bands, thus providing additional flexibility when planning, adjusting, and optimizing the coverage, and increasing the capacity of the network. Also, the slim form factor of the radiating system as described by the present invention enables slimmer, lighter towers to support such radiating systems, which are easier to carry to the roof of buildings (through elevators, through stairs or small gear systems) where the systems might be installed. Also, such slim systems enable such lighter and portable towers to be implemented as a cascading of modular elements, and also, to introduce folding, retracting or bending mechanisms for an easier installation. Also, the slim site can be easily disguised in the form of other urban architectural elements (such as for instance street light poles, chimneys, flag posts, advertisement posts and so on) while at the same time integrating other equipment (such as filters, diplexers, tower mounted low-noise amplifiers and/or power amplifiers) in a single, compact unit.

One aspect of the invention refers to a Slim Stacked dual band antenna array using compact antenna and compact phase shifter technology to allow the integration of three dual band antennas on a slim cylinder, that result in a base station of reduced size and reduced visual impact when compared to the radiating part of current base stations. More specifically, the diameter of this slim array that compose the radiating part of the base station is typically less than 2 wavelengths for the longest operating wavelength, and in some embodiments, such a diameter is less than 1.6, 1.5, 1.4 or 1.3 wavelengths, which is significantly smaller than the size of the radiating part of typical base stations. The invention therefore provides as well a method for reducing the size of the radiating part of the base station, and therefore a method for minimizing the environmental and visual impact of a network of cellular base station antennas. Also, this provides a means of reducing the cost of installation of the whole network, and a means to speed-up the deployment of the network.

A particular embodiment of this invention includes a Dual Band and dual polarized array with independent variable down-tilt for each frequency band. The ratio between frequency bands is less than 2, and in some preferred embodiments less than 1.6, 1.5, 1.4, 1.3, 1.2 and 1.15. In particular, this invention is suitable for combining frequency bands such as UMTS and GSM1800 (DCS), UMTS with PCS1900 or in general two or more cellular or wireless systems operating in the vicinity of the 1700 MHz-2700 MHz frequency range. For instance, in the case of UMTS (1920 MHz-2170 MHz) the central frequency is f2=2045 MHz, while for GSM1800 (1710 MHz-1880 MHz) the central frequency is f1=1795 MHz. In a preferred embodiment the ratio between both frequencies is f2/f1=1,139 which is smaller than 1.3. In some embodiments the ratio is computed from the central frequencies of the band. In some embodiments the ratio is computed from other frequencies chosen at the two bands.

The width and thickness of this antenna is small compared to typical Dual Band base station antenna. Particularly the width is less than two wavelengths, such as for instance one and half wavelengths (1.5λ), 1.4 times the wavelength (1.4λ), 1.3 times the wavelength (1.3λ) and even in some embodiments less than one wavelength (λ) for any of the operating bands. The thickness of this antenna is less than one third of the wavelength, such as for instance 0.3 times the wavelength (0.3λ) and even in some embodiments less than one third of the wavelength (0.3λ) for any of the operating bands. Despite of the narrow width and thickness of the antenna, the radiation pattern characteristics, such as vertical and horizontal beam-width, and upper side-lobes suppression, are maintained.

Variable down-tilt is achieved by using a phase shifter and using adequate vertical spacing between radiating elements, less than one λ, but also preferably less than ¾ of λ and less than ⅔ of λ at all frequencies of operation to maintain a good radiation pattern. Such a spacing is specified, for instance, taking into consideration the center of the radiating elements. In a preferred embodiment, the phase shifter comprises a movable transmission line above a main transmission line.

The invention allows the integration of three dual band antennas in a slim cylinder due to the compact phase-shifter that allows variable electrical downtilt, being the downtilt independent for the two operating bands of the dual band antenna. The thickness of the phase shifter is less than 0.07 times the wavelength (0.07λ).

The invention makes it possible to integrate three dual band antennas in a slim cylinder, due to the use of compact radiating elements and compact ground plane. When considering the maximum length in the axis of the array, these radiating elements are smaller than half a wavelength (λ/2) at the frequency of operation, but also smaller than λ/3 in several embodiments. Several techniques are possible to reduce the size of the radiating elements within the present invention, such as for instance using space-filling structures, multilevel structures, box-counting and grid dimension curves, dielectric loading and fractal techniques.

Therefore, one aspect of the present invention refers to a multiband antenna system for cellular base stations, which includes at least one multiband antenna array, wherein each antenna array comprises a first set of radiating elements operating at a first frequency band and a second set of radiating elements operating at a second frequency band. The radiating elements of this antenna system are smaller than λ/2 or smaller than λ/3, being (λ) the longest operating wavelength. Preferably the ratio between the largest and the smallest of said frequency bands is smaller than 2. This ratio can be computed from the largest and smallest operating frequency within the bands, or by taking the central frequencies of each band.

In a preferred embodiment said antenna arrays are radially spaced from a central axis of the antenna system, and each antenna array is longitudinally (i.e., along the direction of the central axis) placed within an angular sector defined around said central axis.

BRIEF DESCRIPTION OF THE DRAWINGS

To complete the description and in order to provide for a better understanding of the invention, a set of drawings is provided. Said drawings form an integral part of the description and illustrate a preferred embodiment of the invention, which should not be interpreted as restricting the scope of the invention, but just as an example of how the invention can be embodied. The drawings comprise the following figures.

DESCRIPTION OF THE PREFERRED EMBODIMENT OF THE INVENTION

Figure 4:
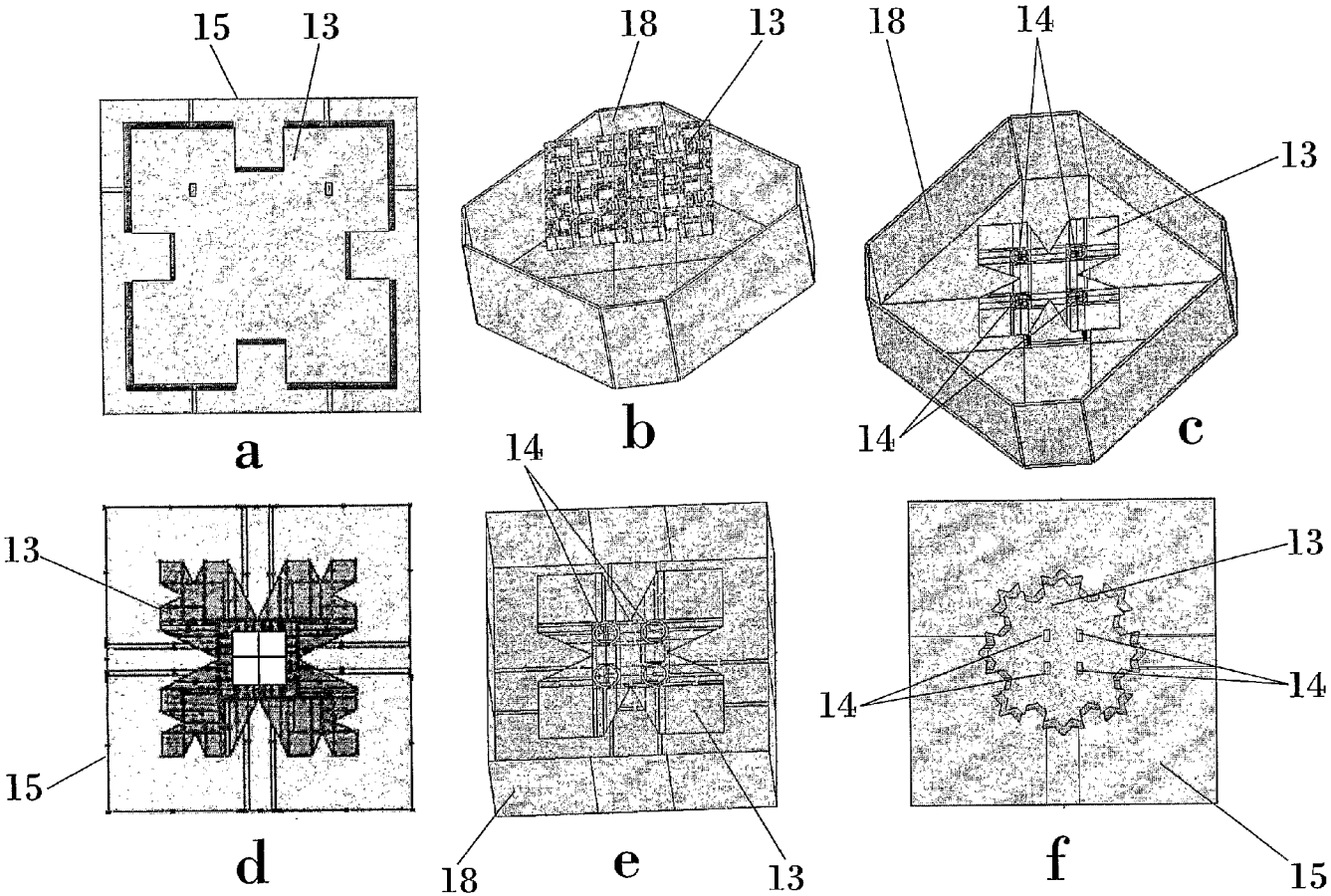
FIG. 4.—shows examples of some possible embodiments of the small radiating elements for the antenna array. In figures (b), (c) and (e) the radiating elements are represented in perspective and housed within a box type ground-plane. In figures (a), (d) and (f) the radiating elements are shown in a plan view.

The multiband antenna array of the invention comprises a first set of radiating elements (17) operating at a first frequency band and a second set of radiating elements (16) operating at a second frequency band. The radiating elements of this antenna system are smaller than λ/2 or smaller than λ/3, being (λ) the longest operating wavelength. FIG. 4 shows a few examples of some possible radiating elements (13) that might be used within the scope of the present invention. The height of the radiating elements (13) with respect to the ground plane of the antenna is also small, helping the integration of three dual band antennas on a slim cylinder. Such a height (13) is smaller than 0.15 wavelengths (0.15λ) at the frequency of operation, but also smaller than 0.08λ in several embodiments. Such reduced height is possible because of the feeding technique used to feed the elements. In some embodiments, the radiating elements (13) placed on substrate (15) are fed in four points (14) and the two ports with the same polarization are combined with a divider, resulting in an element with two ports, that exhibits orthogonal polarizations.

These four feeding points (14) can be feeding the radiating element (13) for instance by direct contact or by capacitive coupling. In case of using the capacitive coupling, no electrical contact is required to connect the element, so solder joints or metal fasteners are avoided on the element. This can improve inter-modulation performance and it is one of the preferred arrangements of the invention. In some embodiments the aspect ratio of the elements (vertical:horizontal sizes) will be 1 to 1 (1:1), in some other preferred embodiments, a deviation smaller than a 15% in one of axes will be introduced in at least one of the elements to improve the polarization isolation, the isolation between connectors of different bands, or both.

Figure 5:
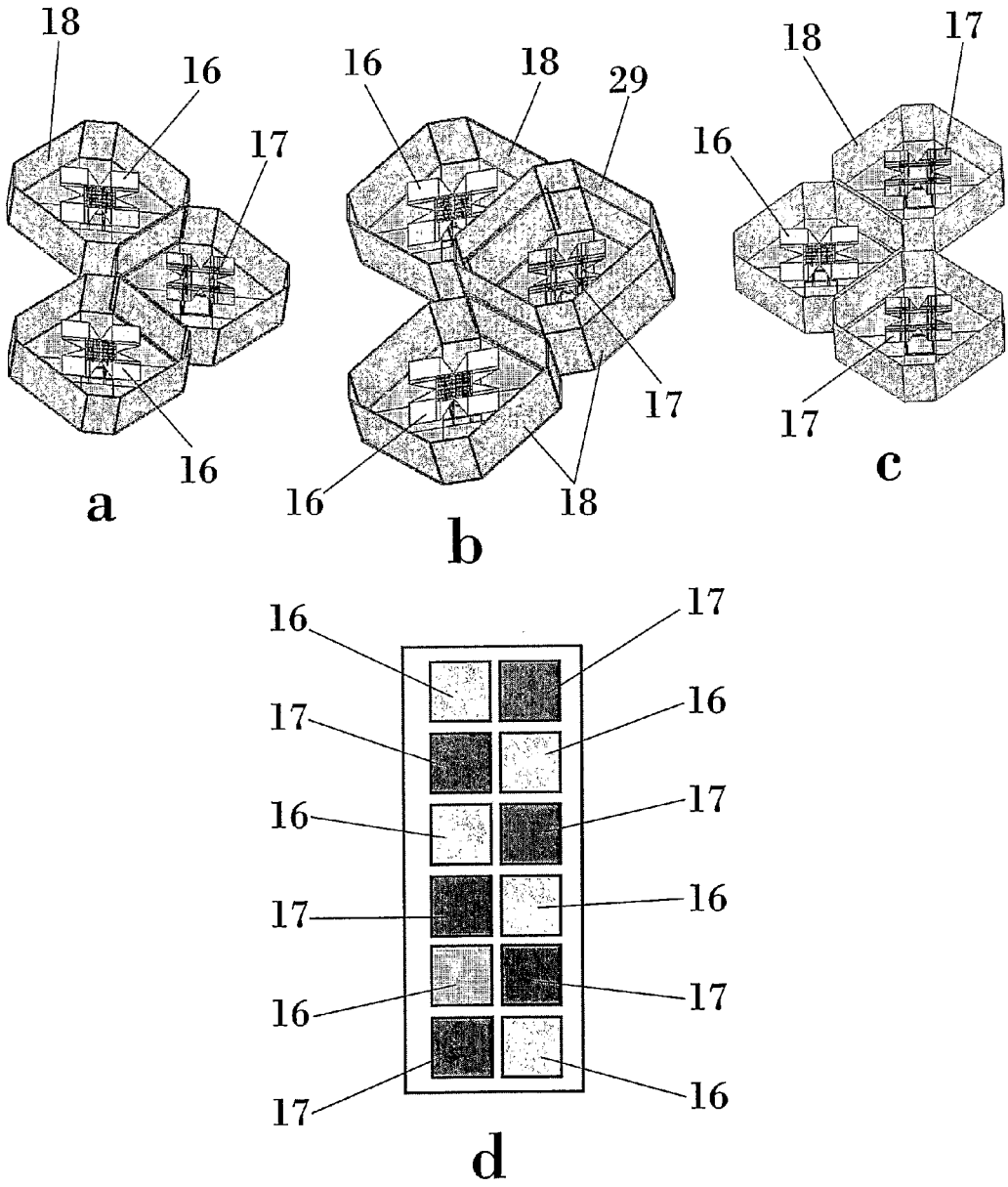
FIG. 5.—shows in figures (a), (b) and (c) perspective views of examples of the arrangement of interleaving radiating elements working at different frequencies. Figure (d) is a schematic plan view of the interlaced disposition of the radiating elements. The position of each radiating element is represented by a square and the elements for a first frequency are shown in lighter shading, and the elements for a second frequency are shown in darker shading.

In order to further reduce the size of the antenna system, the radiating elements (13) of each multiband antenna array may be interlaced in different configurations. An example of the interlaced arrangement of the radiating elements is shown in FIG. 5. The radiating elements of a first frequency band (16) are interlaced with the radiating elements of a second frequency band (17).

More in detail, and in view of FIG. 5*d*, all the radiating elements are arranged in a matrix defined by two substantially parallel columns and a plurality of substantially parallel horizontal rows. In each column, each radiating element of one frequency band is placed in between radiating elements of the other frequency band. In addition, in each row two radiating elements of different frequency bands are facing each other. In this interlaced disposition, each radiating element of one frequency band is vertically and horizontally adjacent to radiating elements of the other frequency band. In some embodiments, all the elements in the array are sequentially interlaced, while in other embodiments only a fraction of the elements are interlaced and some others remain on their respective side-by-side columns with no interlacing.

Figure 6:
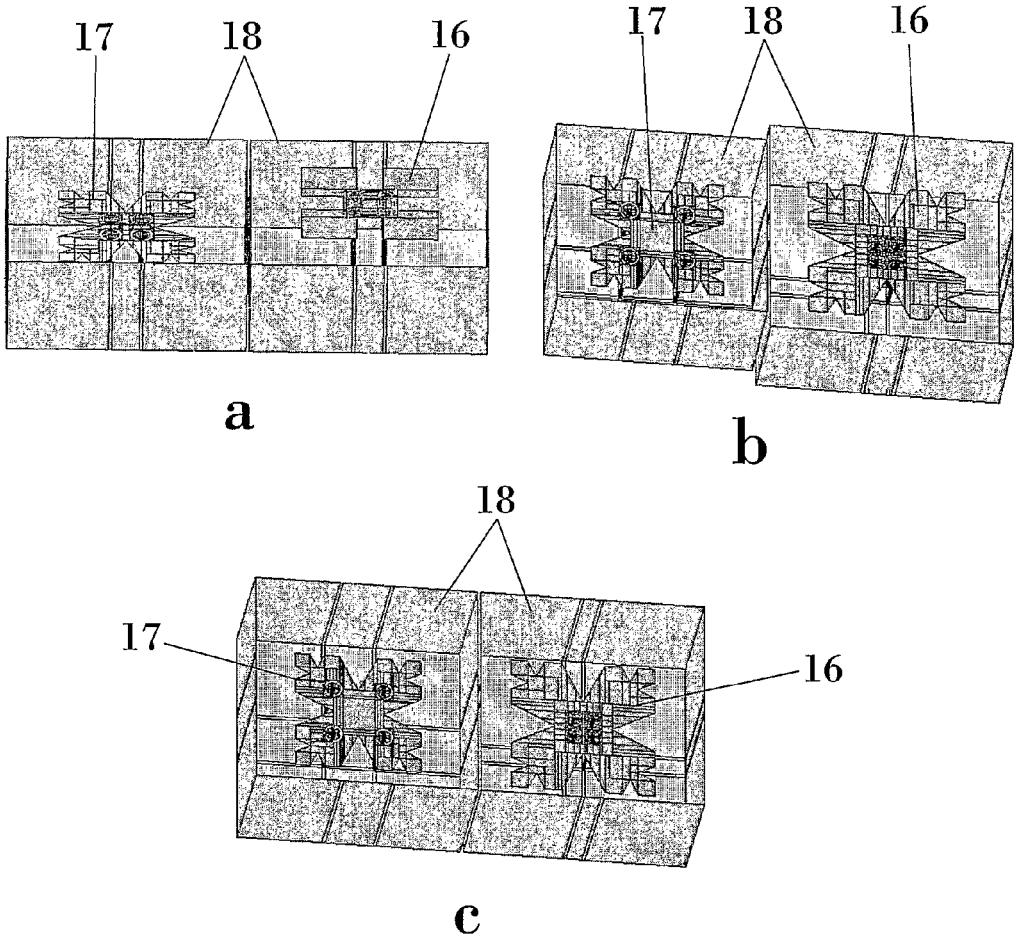
FIG. 6.—shows in perspective more examples of interleaving radiating elements working at different frequencies according to the present invention.

Examples of interleaving radiating elements working at different frequencies, are shown in FIGS. 5*a,b,c* and in FIG. 6.

The horizontal separation between elements (centre to centre) is smaller than λ/2, but bigger than λ/3 to maintain the proper horizontal beamwidth (<75 degrees). It could be less than λ/3 if broader horizontal beamwidth (>70 degrees) is required.

A horizontal offset between bands is also introduced in some embodiments to adjust horizontal beamwidth. This is for instance shown in FIG. 7, where the horizontal spacing between interlaced elements (16) is smaller than the horizontal spacing between interlaced elements (17).

Figure 7:
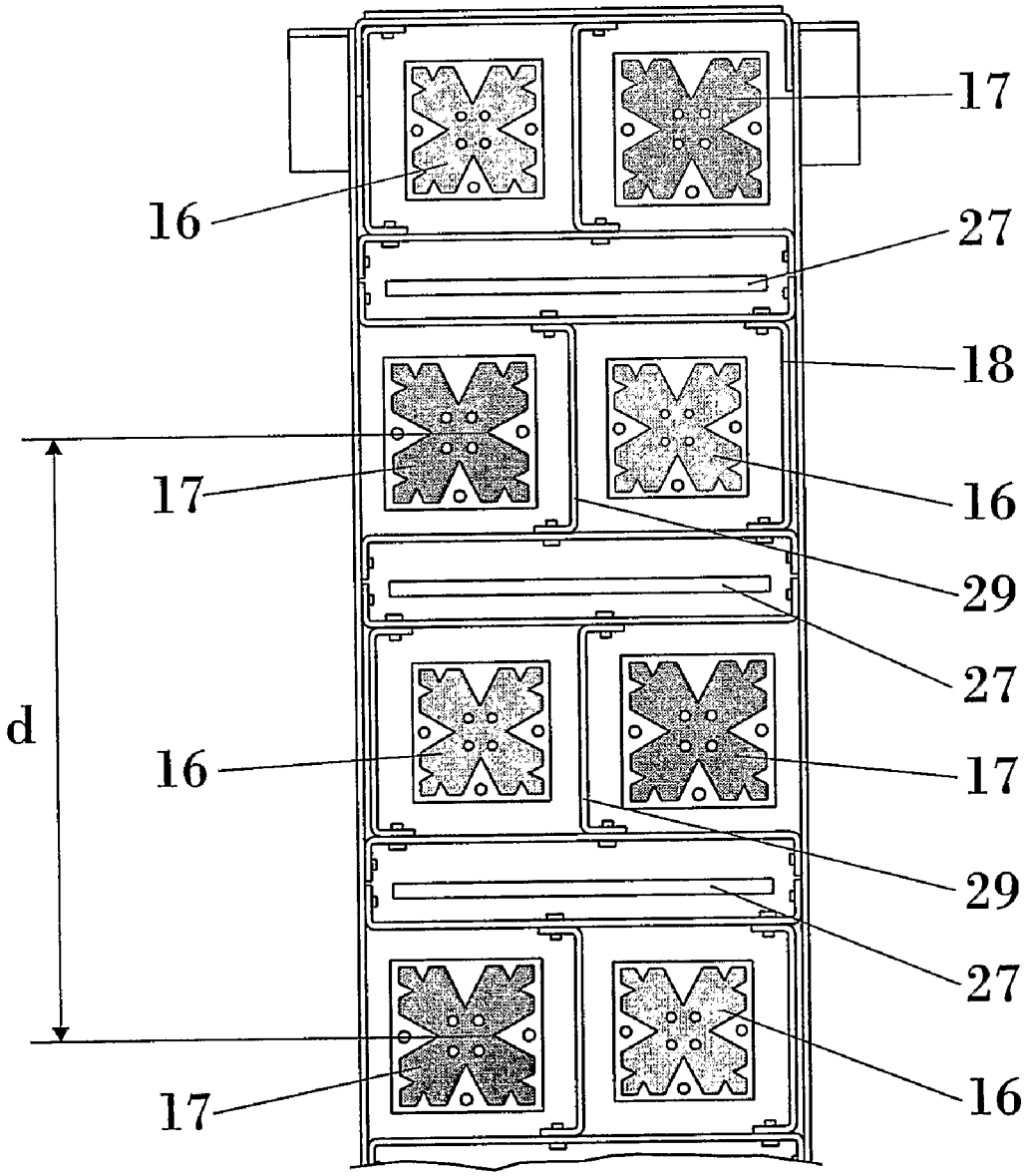
FIG. 7.—shows a front view of the top portion of an antenna array, showing the arrangement of the radiating elements and its interlaced configuration.

FIG. 7 shows a practical embodiment of a multiband antenna array in which the radiating elements (16),(17) of the two frequency bands are interlaced as previously described. Several features are included in some embodiments to improve isolation between polarization and cross-polarization level, for instance each column of elements having a discontinued ground plane in between, for which slots (27) are provided therein. In some embodiments each radiating element is mounted inside a box type ground plane (18), having side walls connected to a bottom base, whereas the top base is open, so that the radiating element is orthogonally placed with respect to the walls of the box type ground plane (18). The bottom base acts as a ground plane for each radiating elements (16),(17) while the side walls (18) enhance the isolation between radiating elements.

For a better manufacturability, this box (18) can be made of metal casting or injection-moulded plastic covered with a conductor. So there is a possibility to manufacture this antenna without using an extruded or sheet metal ground plane. Also, for better isolation and cross polarization performance, each element should preferably have four feeding points (14) or more, preferably symmetrical, although unsymmetrical embodiments are allowed as well.

The vertical spacing (d) between radiating elements has been represented in FIG. 7, where such spacing has been considered as an example between the centers of consecutive radiating elements of a first frequency band (17). Said vertical spacing (d) may be less than one λ, but also preferably less than ¾ of λ and less than ⅔ of λ at all frequencies of operation to maintain a good radiation pattern.

In some embodiments a Filter/Diplexer is added inside the antenna to achieve greater isolation between electrical ports of different frequency bands.

Figure 8:
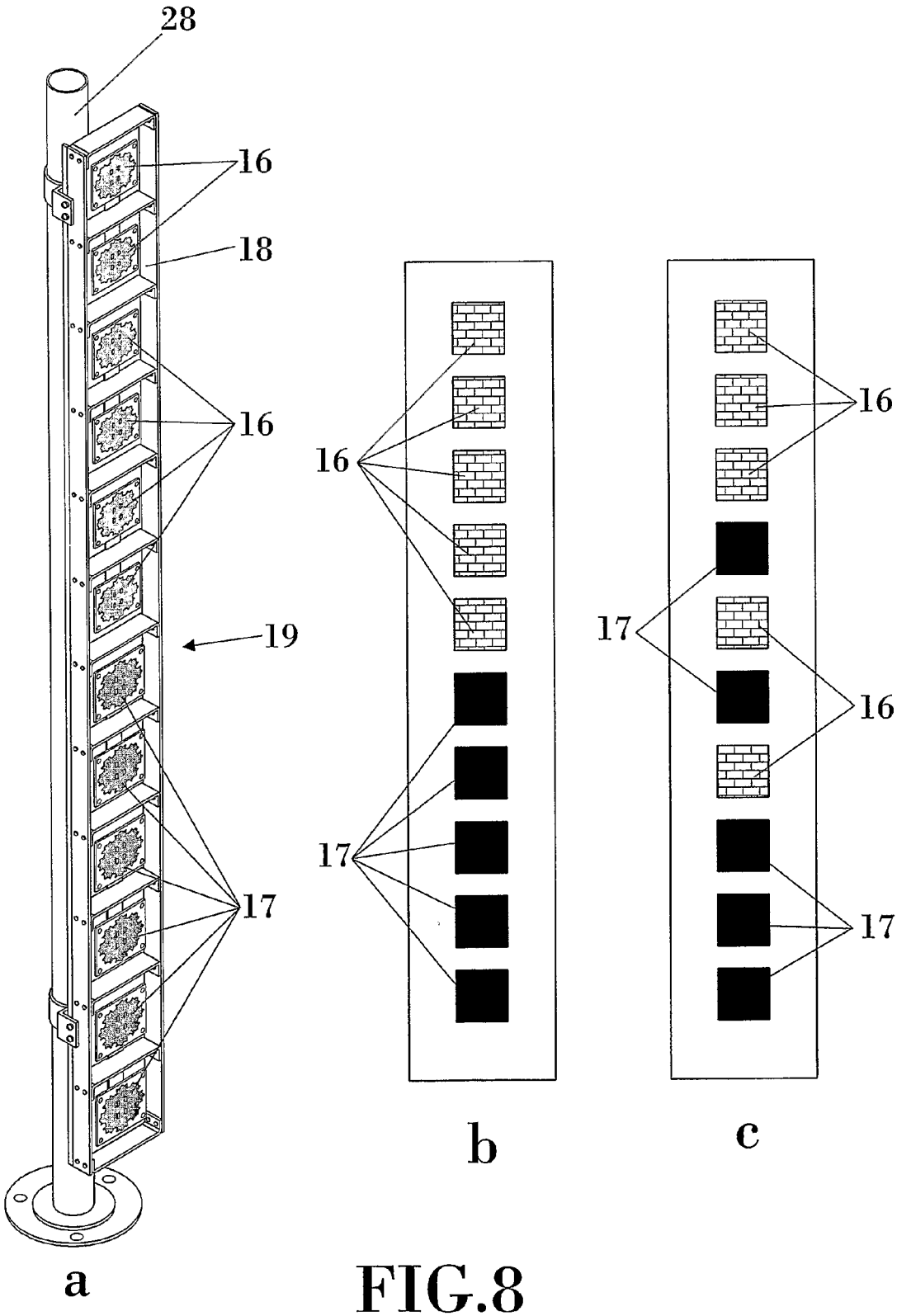
FIG. 8.—shows in figure (a) a perspective view of a preferred arrangement of an antenna array showing the radiating elements and its stacked configuration. Figure (b) is an schematic front view of an example of the spatial arrangement of the stacked radiating elements working at different frequencies (elements for a first frequency shown in black boxes, elements for a second frequency shown in gridded boxes). Figure (c) is a schematic front view of an example of stacked radiating elements in which some elements are interlaced in the central portion of the array.

Alternately, the radiating elements may be arranged in a stacked topology also in order to reduce the size of the antenna array. An example of the spatial arrangement of the stacked radiating elements working at different frequencies is shown in FIG. 8. Squared elements are shown in FIG. 8*b* to illustrate the positions of the elements in the array according to the present invention. Nevertheless, other shapes of elements (for instance space-filling, fractal, multilevel, straight, triangle, circular, polygonal) and antenna topologies (for instance patches, dipoles, slots) are possible according to the invention. All the radiating elements are aligned in a single column, wherein the elements of a first frequency band (17) are grouped together in the column below the elements of a second frequency band (16) which are grouped at the top portion of the column. In some embodiments, the second frequency band is the highest frequency one to reduce the gain difference between bands. When the gain at the upper band is to be maximized, the highest frequency elements are preferably placed in the lower section of the stack.

The number of radiating elements at each of the two regions for each band does not need to be the same. Different number of elements will be preferably used in those cases where a different radiation pattern for each band is desired. The spacing between elements will preferably be between 0.6λ and 1.2λ at the shortest operating band within each corresponding region. For instance, in some embodiments the physical distance between elements in a first frequency region will be different than the physical distance between elements in a second frequency region, but the electrical distance (in terms of their corresponding operating frequencies) will be substantially similar.

A preferred embodiment with stacked configuration of the radiating elements is shown in FIG. 8*a*, wherein each radiating element is located within a box-like ground plane (18).

The vertical separation between stacked arrays (centre to centre of each group of elements corresponding to a band) is larger than λ, such distance is modified to control the gain adding more elements. In some embodiments, as shown in FIG. 8*c* it is possible to interlace some elements of a first frequency (17) with some elements of a second frequency (16) to modify the radiation pattern and gain of the antenna.

Several features are included in some embodiments to improve isolation between polarization and cross-polarization level, for instance some flanges (29) between elements. In some embodiments, the flanges (29) will be placed between every single radiating element and will have the same shape. In other embodiments, further improvement of the polarization isolation is achieved by using asymmetrical arrangements and distributions of flanges (29) between radiating elements, as shown for instance in FIG. 5*b*.

In FIG. 8*a* only one antenna array has been represented mounted on a central support (28), however a preferred embodiment of the invention comprises two additional antenna arrays to form a tri-sector antenna. Therefore, one of the main advantages of the present invention is that it is possible to integrate three dual band antennas in a slim cylinder, forming a tri-sector antenna. A single cylinder radome (22) can be used. This technique is used to reduce visual impact by Base Station Antenna Manufacturers. However, in the case of this Dual Band antenna, the diameter of the circumference formed by the three antennas is less than 2λ at the greater frequency of each band, and even less than 1.5λ. This is achieved because of the compact size and architecture of each Dual Band antenna.

In some embodiments, the number of radiating elements around the central support (28) will be just two, while in some other embodiments this number will be larger than three, preferably 4, 5 or 6.

In some embodiments, an angular spacing is introduced between antennas, and a mechanical feature is added in order to adjust the horizontal boresight of each sector so optimising the azimuth coverage. In this particular case, the diameter of the total circumference formed by the three antennas is still less than 2λ, and even less than 1.82λ at the highest frequency, with an angular spacing of at least 20 degrees. Smaller diameter is achieved in some embodiments by reducing the angular spacing and/or its adjustment range.

In order to shrink the diameter of a tri-sector Dual Band even further, small radiating elements with smaller ground plane are used in some embodiments including a stacked configuration according to the present invention. As shown in FIG. 9, the antenna arrays (19, 19', 19") are radially spaced from a central axis (21) of the antenna system. Each antenna array (19, 19', 19") is respectively placed longitudinally within an angular sector (20, 20', 20") defined around said central axis (21), the antenna arrays (19, 19', 19") being substantially parallel to said central axis (21). The three antenna arrays (19, 19', 19") are housed within a substantially cylindrical radome (22), which is preferably made of dielectric material and is substantially transparent within the 1700-2700 MHz frequency range. As shown in FIG. 9, each array is placed according to the position of the sides of an equilateral triangle, which center is the axis (21) of the antenna system. The central support (28) is aligned with respect said axis (21), and the antenna arrays (19, 19', 19") are mounted on said central support (28) at a selected distance.

Figure 9A:
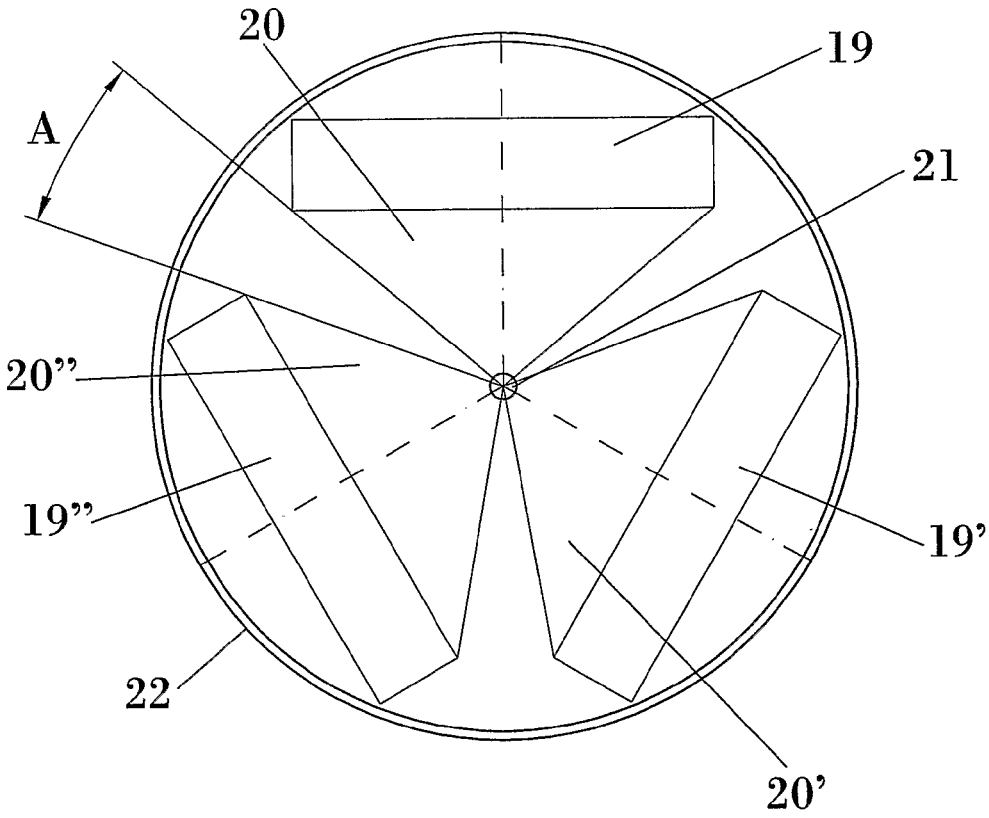
FIG. 9.—shows a schematic cross-sectional views of a tri-sector antenna housed within a cylindrical radome. The three rectangular shapes represent the antenna arrays in a top view. Figure (a) shows three dualband antennas forming a tri-sector with 20 degrees of angular spacing. Figure (b) shows a tri-sector antenna without angular spacing, and figure (c) a tri-sector antenna with 20 degrees of angular spacing and ground-planes with bent flanges.
Figure 9B:
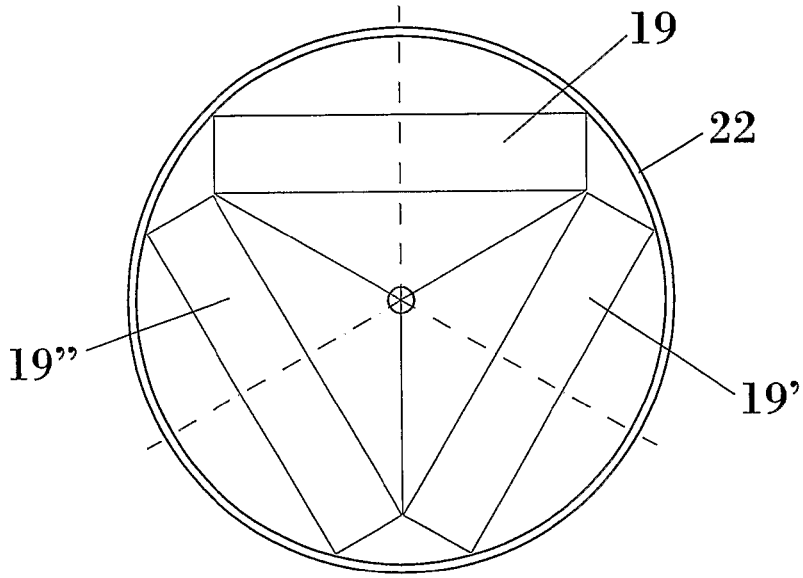

In the embodiment of FIG. 9*a*, the three angular sectors (20, 20', 20") are less than 120° so that an angular spacing (A) is defined between said angular sectors. Preferably, said angular spacing (A) is within the range 0° to 30°. In the embodiment of FIG. 9*b* the diameter of the cylindrical radome (22) is reduced with respect to the embodiment of FIG. 9*a*, for which the three angular sectors (20, 20', 20") extend 120° so that there is no angular spacing (A) in between. The antenna arrays (19, 19', 19") may be in contact at their sides.

Figure 9C:
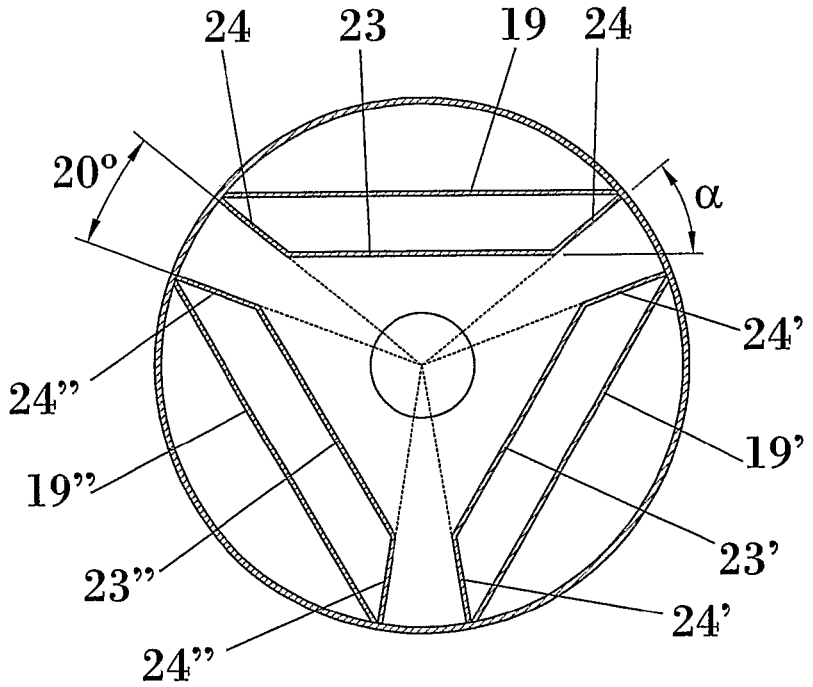

FIG. 9*c* is an example of a Tri-Band antenna with three independent down-tilt and an angular spacing of 20 degrees. For each antenna array (19, 19', 19") the ground plane profile (23, 23', 23") has flanges (24, 24', 24") bent upwards at the optimum angle for minimizing antenna diameter and maximizing aperture of radiation, which is 40 degrees in this example.

For any given tri-sector antenna, there is always the compromise of:

- having the smallest radome diameter for lower visual impact and lower windload, allowing the mimetization of the radiating part of the base station with the environment,
- having the biggest angular spacing for more flexibility in optimising the azimuth coverage of each sector,
- having the maximum horizontal radiation aperture to increase the directivity of the antenna in the horizontal plane.

In some embodiments, a preferred angle (α) that would allow the best compromise is equal to 30 degrees+Angular Spacing (A) divided by 2:

$$\alpha=30+A/2$$

where (α) is the angle between the horizontal and the flanges of the ground plane and (A) is the angular spacing between 2 antennas.

Each multiband antenna array is provided with a phase shifter device providing an adjustable electrical downtilt for each frequency band. The phase shifter includes an electrical path of variable length, for which the phase shifter preferably comprises a first transmission line slideably mounted on a second transmission line.

Figure 1:
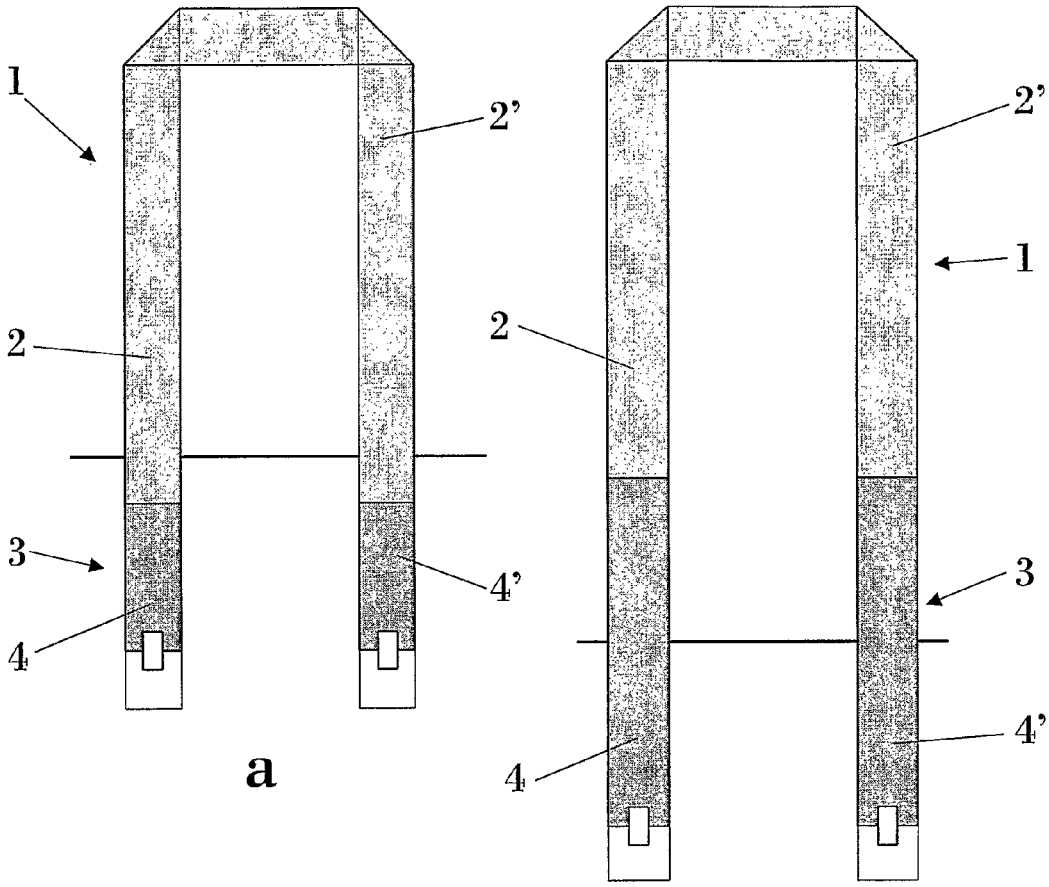
FIG. 1.—shows a schematic plan view of an example of a U shaped microstrip or strip-line phase shifter. In figure (a) the phase-shifter is at its minimum phase position and in figure (b) it is at its maximum phase position. The moveable transmission line is shown in lighter shading than the fixed main transmission line.
Figure 2:
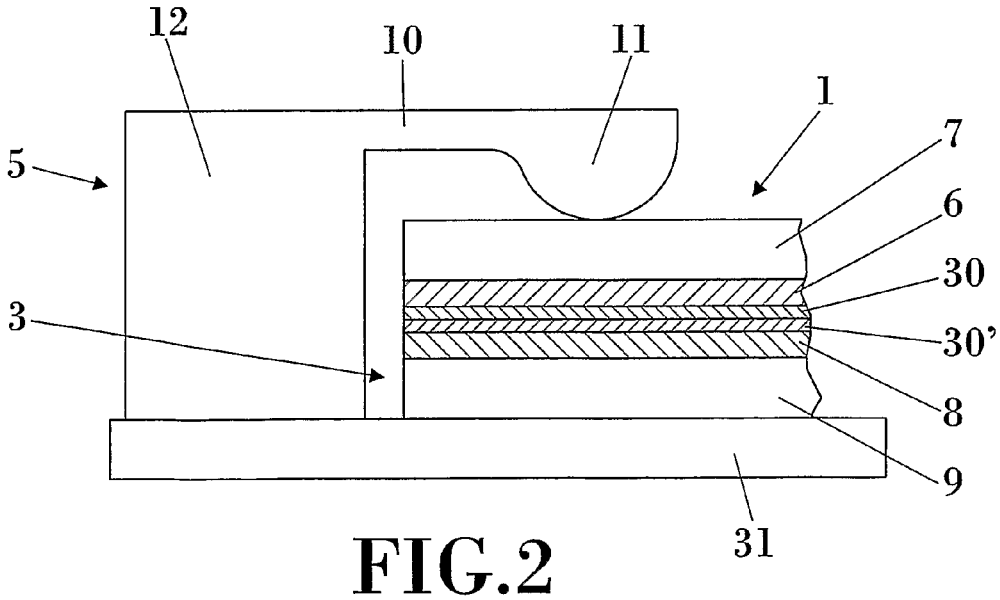
FIG. 2.—shows an elevational front view of a flexible bridge mounted together with a movable transmission line and a main transmission line.
Figure 3:
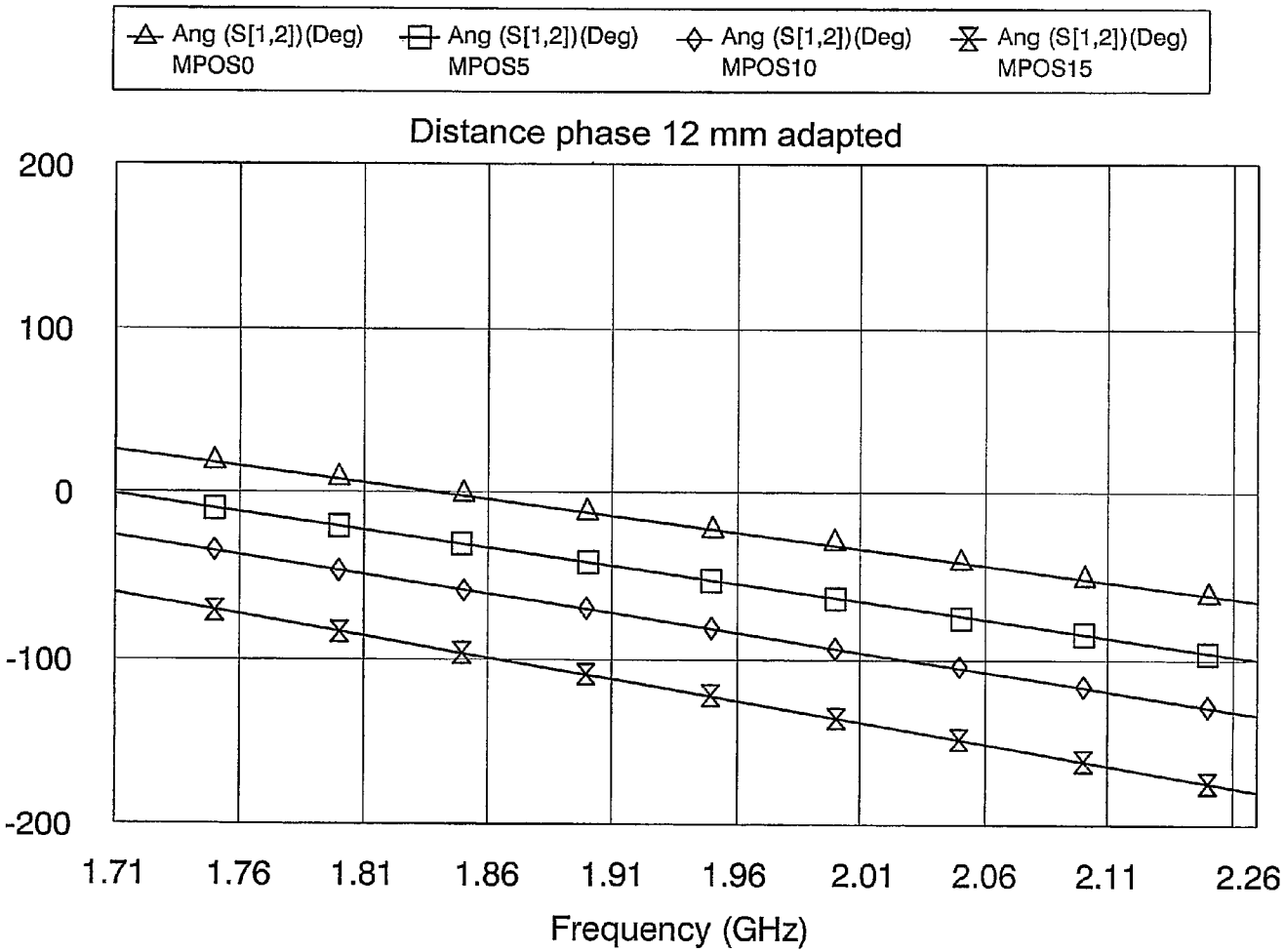
FIG. 3.—shows a graphic representing phase progression for different positions of the phase shifter.

One aspect of the invention refers to the phase shifter shown in FIG. 1, which in a preferred embodiment is formed by a moveable line (1) mounted on a fixed main transmission line (3). The movable line (1) has a "U" shape, but could have another shape featuring two transmission line ends (2, 2') that move together over such main transmission line (3). Preferably, the movable line (1) will have two parallel ends (2, 2') that overlap an interrupted region of the fixed main transmission line (3), such that a linear displacement of said movable line (1) introduces a longer electrical path on a whole transmission line set. As shown in FIG. 2, the moveable line (1) is formed by a first substrate (7) provided with a first conductive layer (6), and the fixed main transmission line (3) is similarly formed by a second substrate (9) and a second conductive layer (8) on one of its faces. The moveable line (1) slides above the main transmission line (3) and both are separated by respective low friction layers (30),(30') of a low microwave loss material, which could be for instance a Teflon base, to increase durability and avoid passive intermodulation (PIMs) at the same time. All parts are sandwiched together with a flexible bridge (5) that acts as a spring to avoid air gaps between layers and so maintaining the proper phase shifting. The bridge (5) is formed by a base (12) fixed for instance to a support (31) of the main transmission line (3). A flexible arm (10) projects horizontally from said base (12) and forms a protuberance (11) at its free end which maintains the moveable line (1) in contact with the main transmission line (3) during its displacement. The bridge (5) acts as a spring due to its shape and the plastic material used. For example, this plastic material can be chosen, without any limiting purpose, from the following set: Polypropylene, Acetal, PVC, and Nylon. This part can be moulded for manufacturability and low cost.

The electrical length of the phase shifter may be adjusted either manually or by means of a small electric motor (not shown), which in turn may be remotely controlled by means of any technique known to the prior art.

Figure 10:
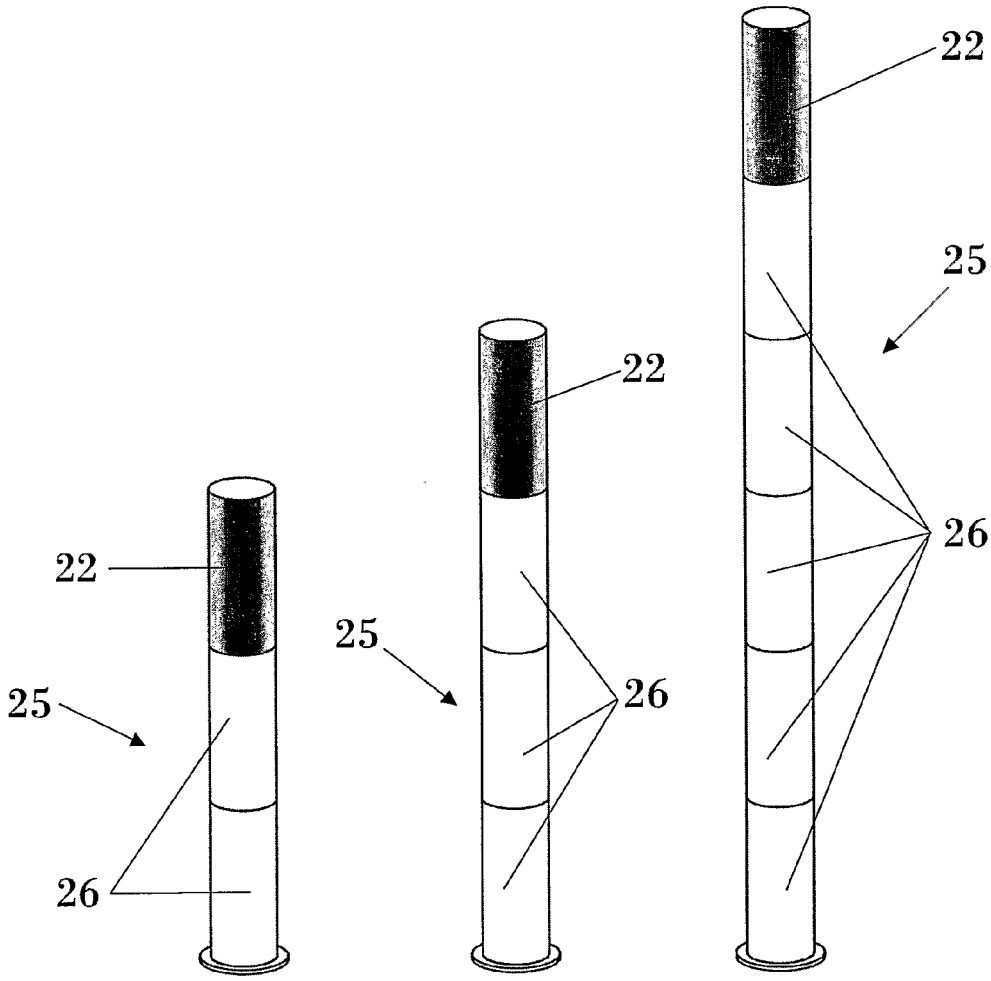
FIG. 10.—shows a perspective view of slim stacked dual band antenna arrays mounted on a modular tower, in three different heights from the floor.

Another feature of the slim stacked dual band array is the integration of a modular system to easily modify the height of the antenna from the floor, as represented in FIG. 10. This modular system for modifying the height of the antenna from the floor, allows to the operator to achieve the desired coverage region for the base station. This is possible owing to the light weight and small profile of the antenna. More in detail, the antenna system is mounted on an elongated tower or support (25) of adjustable height and preferably of cylindrical shape. The support may be formed by one or more modular support sections (26) axially coupled together, by means of any technique known in the state of the art suitable for this purpose. Additionally, the support (25) may comprises hinge means at its bottom end so that the support (25) can be bent to make easier its installation and maintenance. Alternately, the support sectors may form a telescopic structure, and the support (25) can be retracted.

Several techniques are possible to reduce the size of the radiating elements within the present invention, such as for instance using space-filling structures, multilevel structures, box-counting and grid dimension curves.

About Space-Filling Curves

A way of miniaturizing the radiating elements of the Multiband Array is shaping part of the antenna elements (for example at least a part of the arms of a dipole, the perimeter of the patch of a patch antenna, the slot in a slot antenna, the loop perimeter in a loop antenna) as a space-filling curve (SFC), i.e., a curve that is large in terms of physical length but small in terms of the area in which the curve can be included. More precisely, the following definition is taken in this invention for a space-filling curve: a curve composed by at least five segments which are connected in such a way that each segment forms an angle with their neighbours, i.e., no pair of adjacent segments define a larger straight segment. In some embodiments a SFC can comprise straight segments, and in some other embodiments a SFC can comprise curved segments, and yet in other cases a SFC can comprise both straight and curved segments. Also, whatever the design of such SFC is, it can never intersect with itself at any point except the initial and final point (that is, the whole curve can be arranged as a closed curve or loop, but none of the parts of the curve can become a closed loop). A space-filling curve can be fitted over a flat or curved surface, and due to the angles between segments, the physical length of the curve is always larger than that of any straight line that can be fitted in the same area (surface) as said space-filling curve. Additionally, to properly shape the structure of a miniature antenna according to the present invention, the segments of the SFC curves must be shorter than at least one fifth of the free-space operating wavelength, in some embodiments preferably shorter than one tenth of the free-space operating wavelength. Although five is the minimum number of segments to provide some antenna size reduction, in some embodiments a larger number of segments can be chosen, for instance 10, 20 or more. In general, the larger the number of segments and the narrower the angles between them, the smaller the size of the final antenna.

About the Box-Counting Dimension

One aspect of the present invention is the box-counting dimension of the curve that forms at least a portion of the antenna. For a given geometry lying on a surface, the box-counting dimension is computed in the following way: first a grid with substantially squared identical cells boxes of size L1 is placed over the geometry, such that the grid completely covers the geometry, that is, no part of the curve is out of the grid. Then the number of boxes N1 that include at least a point of the geometry are counted; secondly a grid with boxes of size L2 (L2 being smaller than L1) is also placed over the geometry, such that the grid completely covers the geometry, and the number of boxes N2 that include at least a point of the geometry are counted again. The box-counting dimension D is then computed as:

$$D = -\frac{\log(N2) - \log(N1)}{\log(L2) - \log(L1)}$$

In terms of the present invention, the box-counting dimension is computed by placing the first and second grids inside the minimum rectangular area enclosing the curve of the antenna and applying the above algorithm.

The first grid should be chosen such that the rectangular area is meshed in an array of at least 5×5 boxes or cells, and the second grid is chosen such that L2=½ L and such that the second grid includes at least 10×10 boxes. By the minimum rectangular area it will be understood such area wherein there is not an entire row or column on the perimeter of the grid that does not contain any piece of the curve. Thus, some of the embodiments of the present invention will feature a box-counting dimension larger than 1.1, and in those applications where the required degree of miniaturization is higher, the designs will feature a box-counting dimension ranging from 1.3 up to 3, inclusive. These curves featuring at least a portion of its geometry with a box-counting dimension larger than 1.1 will be also referred as box-counting curves.

For some embodiments, a curve having a box-counting dimension close to 2 is preferred. For very small antennas, that fit for example in a rectangle of maximum size equal to one-twentieth of the longest free-space operating wavelength of the antenna, the box-counting dimension will be necessarily computed with a finer grid. In those cases, the first grid will be taken as a mesh of 10×10 equal cells, while the second grid will be taken as a mesh of 20×20 equal cells, and then D is computed according to the equation above. In general, for a given resonant frequency of the antenna, the larger the box-counting dimension the higher the degree of miniaturization that will be achieved by the antenna. One way of enhancing the miniaturization capabilities of the antenna according to the present invention is to arrange the several segments of the curve of the antenna pattern in such a way that the curve intersects at least one point of at least 14 boxes of the first grid with 5×5 boxes or cells enclosing the curve. Also, in other embodiments where a high degree of miniaturization is required, the curve crosses at least one of the boxes twice within the 5×5 grid, that is, the curve includes two non-adjacent portions inside at least one of the cells or boxes of the grid.

Figure 11:
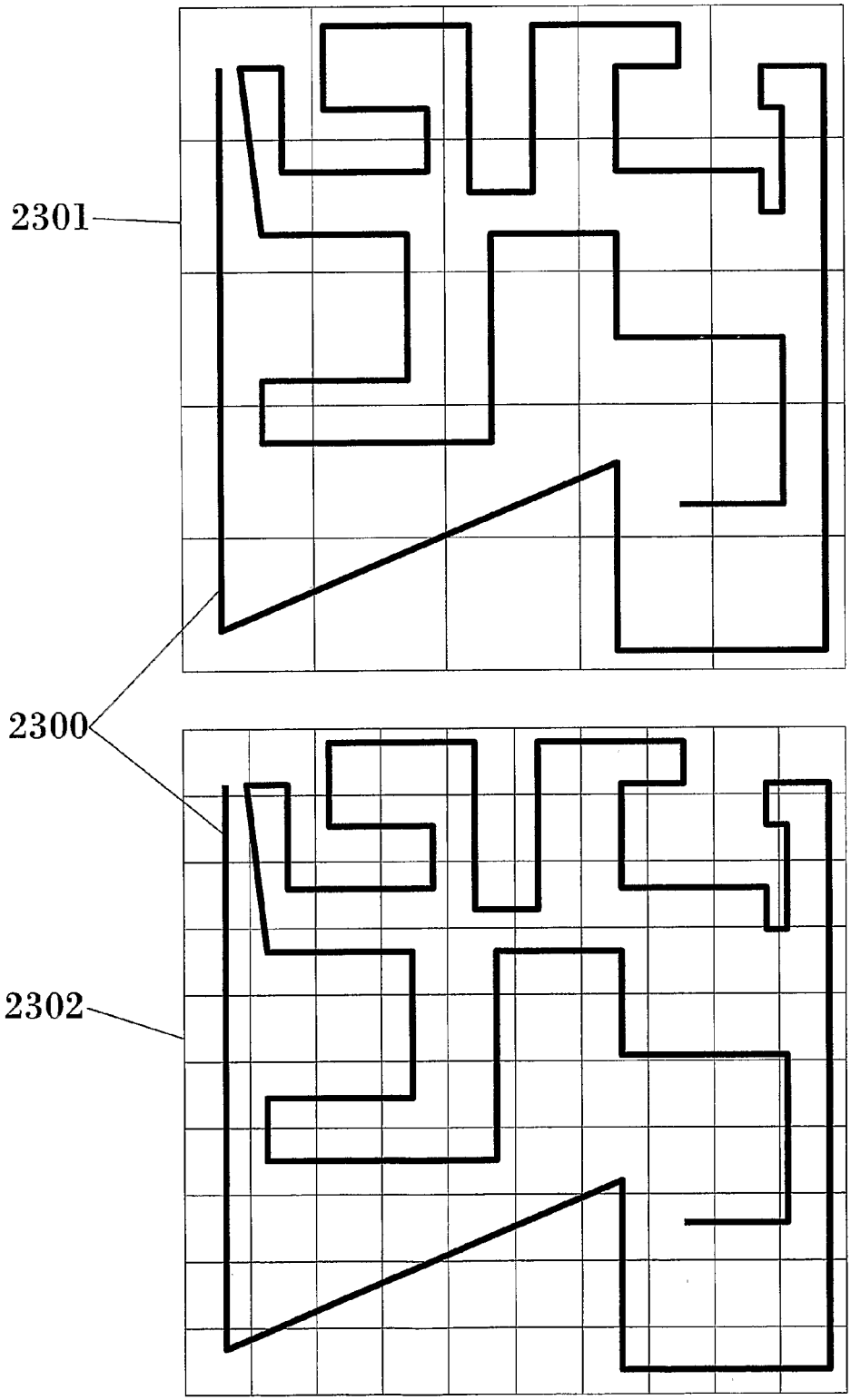
FIG. 11.—shows an example of how the box-counting dimension is computed according to the present invention.

An example of how the box-counting dimension is computed according to the present invention is shown in FIG. 11. An example of a curve (2300) according to the present invention is placed under a 5×5 grid (2301) and under a 10×10 grid (2302). As seen in the graph, the curve (2300) touches N1=25 boxes in grid (2301) while it touches N2=78 boxes in grid (2302). In this case the size of the boxes in grid (2301) is twice the size of the boxes in (2302). By applying the equation above it is found that the box-counting dimension of curve (2302) is, according to the present invention, equal to D=1.6415. This example also meets some other characteristic aspects of some preferred embodiments within the present invention. The curve (2300) crosses more than 14 of the 25 boxes in grid (2301), and also the curve crosses at least one box twice, that is, at least one box contains two non-adjacent segments of the curve. In fact, (2300) is an example where such a double crossing occurs in 13 boxes out of the 25 in (2301).

About Grid Dimension

Analogously, in some embodiments, the radiating elements of the Multi Band Array of the present invention include a characteristic grid dimension curve forming at least a portion of the at least one radiating element of the antenna. A grid dimension curve does not need to show clearly distinct segments and can be a completely smooth curve. For a given geometry lying on a planar or curved surface, the grid dimension in a grid dimension curve is computed in the following way:

first a grid with substantially identical cells of size L1 is placed over the geometry of said curve, such that the grid completely covers the geometry, and the number of cells N1 that include at least a point of the geometry are counted; secondly a grid with cells of size L2 (L2 being smaller than L1) is also placed over the geometry, such that the grid completely covers the geometry, and the number of cells N2 that include at least a point of the geometry are counted again. The grid dimension D is then computed as:

$$D = -\frac{\log(N2) - \log(N1)}{\log(L2) - \log(L1)}$$

In terms of the present invention, the grid dimension is computed by placing the first and second grids inside the minimum rectangular area enclosing the curve of the antenna and applying the above algorithm. By the minimum rectangular area it will be understood such area wherein there is not an entire row or column on the perimeter of the grid that does not contain any piece of the curve.

The first grid should be chosen such that the rectangular area is meshed in an array of at least 25 substantially equal cells, and the second grid is chosen such that each cell on said first grid is divided in 4 equal cells, such that the size of the new cells is L2=½ L1, therefore the second grid including at least 100 cells. Thus, some of the embodiments of the present invention will feature a grid dimension larger than 1, and in those applications where the required degree of miniaturization is higher, the designs will feature a grid dimension ranging from 1.5 up to 3 (in case of volumetric structures), inclusive. For some embodiments, a curve having a grid dimension of about 2 is preferred. In any case, for the purpose of the present invention, a grid dimension curve will feature a grid dimension larger than 1.

In general, for a given resonant frequency of the antenna, the larger the grid dimension the higher the degree of miniaturization that will be achieved by the antenna. One way of enhancing the miniaturization capabilities of the antenna according to the present invention is to arrange the several segments of the curve of the antenna pattern in such a way that the curve intersects at least one point of at least 50% of the cells of the first grid with at least 25 cells enclosing the curve. Also, in other embodiments where a high degree of miniaturization is required, the curve crosses at least one of the cells twice within the 25 cell grid, that is, the curve includes two non-adjacent portions inside at least one of the cells or cells of the grid.

Figure 12:
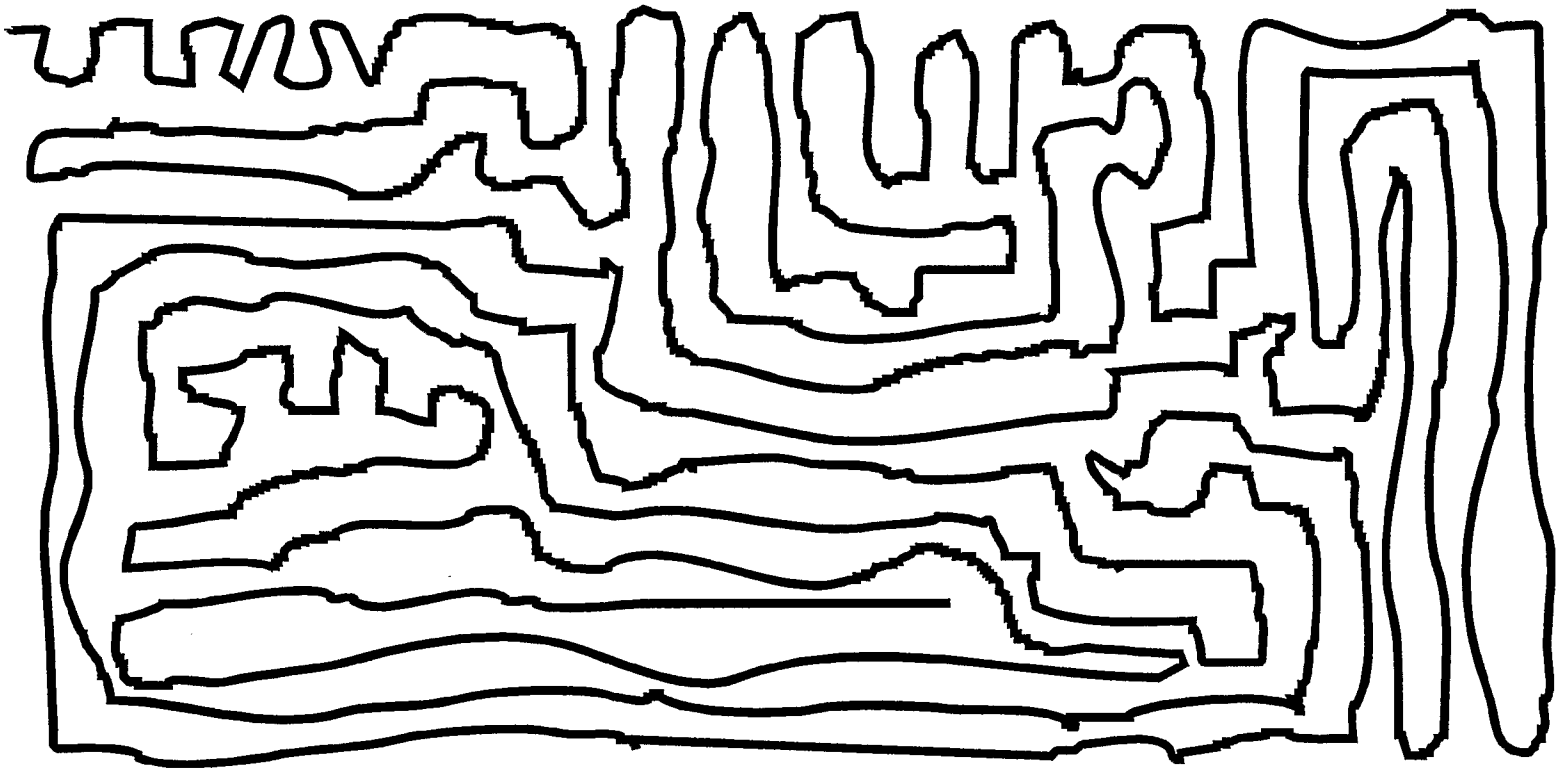
FIG. 12.—shows an example of a curve featuring a grid-dimension larger than 1, also referred here as a 'grid-dimension curve'.
Figure 13:
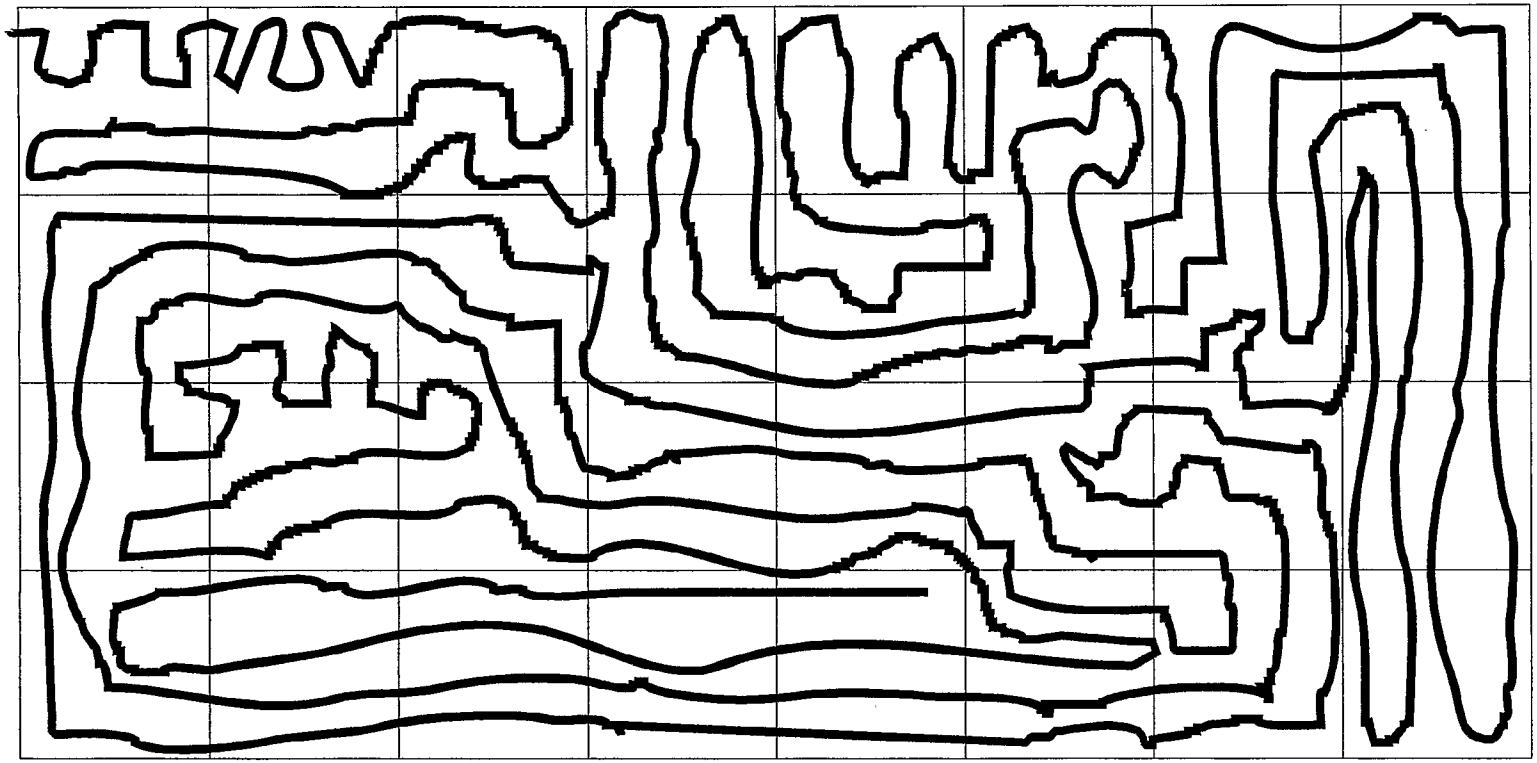
FIG. 13.—shows the curve of FIG. 12 in a 32-cell grid.

FIG. 12 shows an example of a curve featuring a grid-dimension larger than 1, also referred here as a 'grid-dimension curve'. In FIG. 13 the curve of FIG. 12 is in a 32-cell grid. The curve crosses all 32 cells, and therefore N1=32.

Figure 14:
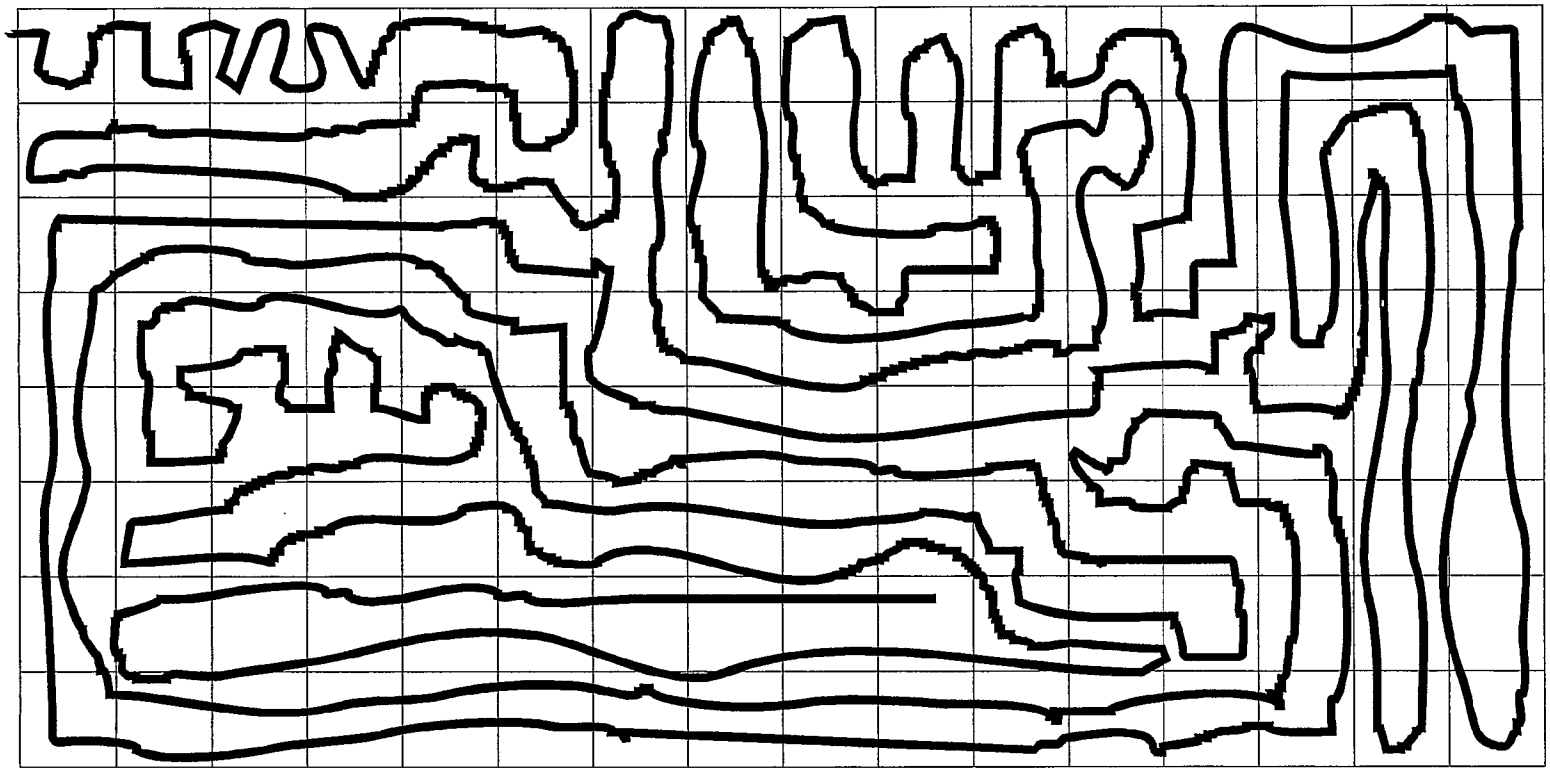
FIG. 14.—shows the curve of FIG. 12 in a 128-cell grid.

In FIG. 14 the curve of FIG. 12 is in a 128-cell grid. The curve crosses all 128 cells, and therefore N2=128.

Figure 15:
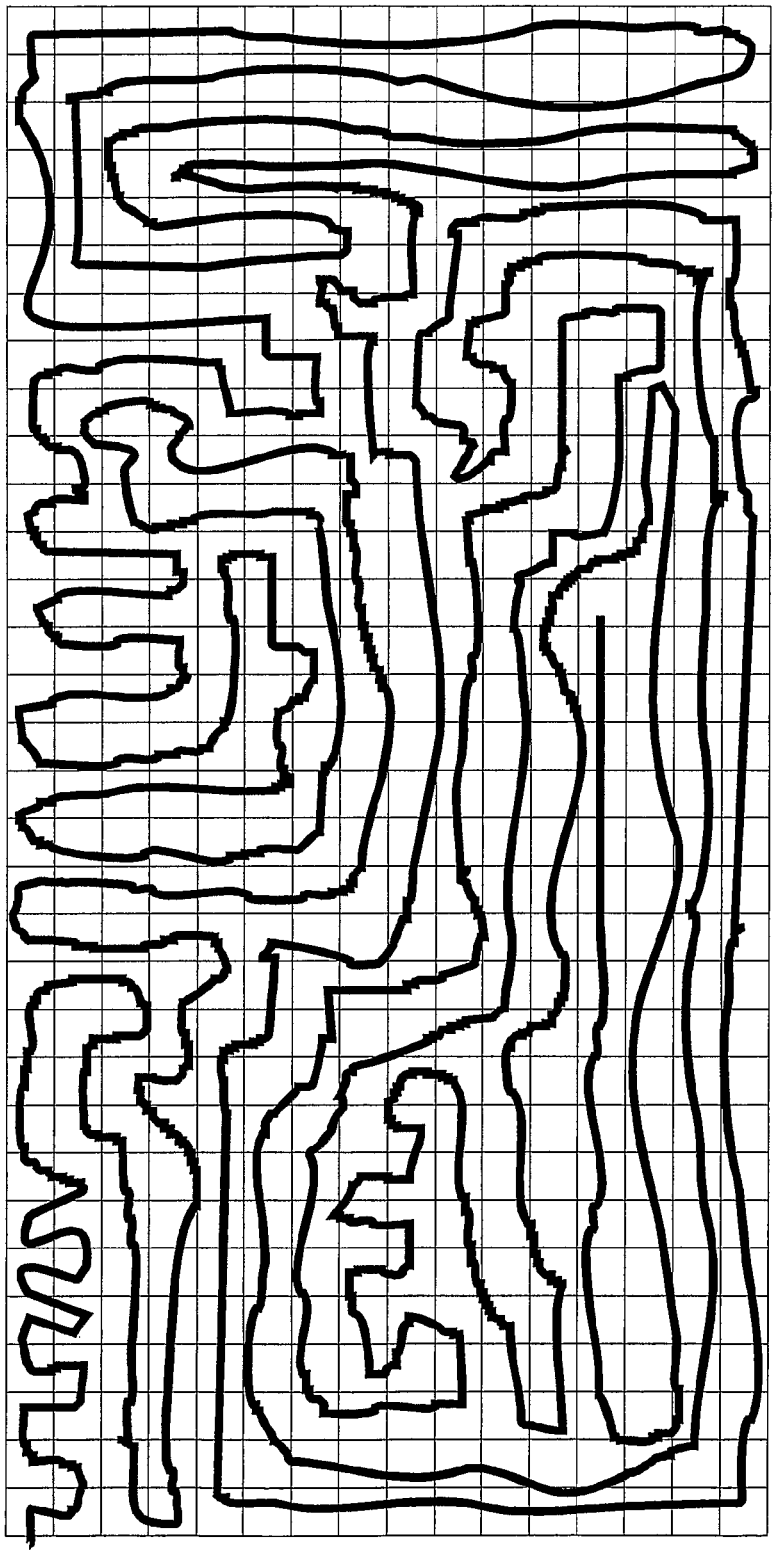
FIG. 15.—shows the curve of FIG. 12 in a 512-cell grid.

In FIG. 15 the curve of FIG. 12 is in a 512-cell grid. The curve crosses 509 cells at least at one point of the cell.

Preferably, the elements in the array, according to the present invention, will be patch antenna elements, having a perimeter or at least one portion of the element structure shaped with a curve of at least 5 segments, being said segments smaller than the longest operating wavelength (λ) divided by 5. Preferably such a curve will feature a box-counting dimension or a grid dimension larger than 1.1, typical above 1.2 or 1.3. For non-rectilinear curves, it will feature a grid-dimension preferably larger than 1.1, typical above 1.2 or 1.3 as well. In general, the larger the box counting or grid-dimension, the smaller the size of the radiating element.

About Multilevel Antennae

The present invention consists of an antenna whose radiating element is characterised by its geometrical shape, which basically comprises several polygons or polyhedrons of the same type. That is, it comprises for example triangles, squares, pentagons, hexagons or even circles and ellipses as a limiting case of a polygon with a large number of sides, as well as tetrahedral, hexahedra, prisms, dodecahedra, etc. coupled to each other electrically (either through at least one point of contact or through a small separation providing a capacitive coupling) and grouped in structures of a higher level such that in the body of the antenna can be identified the polygonal or polyhedral elements which it comprises. In turn, structures generated in this manner can be grouped in higher order structures in a manner similar to the basic elements, and so on until reaching as many levels as the antenna designer desires.

A multilevel structure is characterized in that it is formed by gathering several polygon or polyhedron of the same type (for example triangles, parallelepipeds, pentagons, hexagons, etc., even circles or ellipses as special limiting cases of a polygon with a large number of sides, as well as tetrahedral, hexahedra, prisms, dodecahedra, etc.) coupled to each other electromagnetically, whether by proximity or by direct contact between elements. A multilevel structure or figure is distinguished from another conventional figure precisely by the interconnection (if it exists) between its component elements (the polygon or polyhedron). In a multilevel structure the majority of its component elements (in some embodiments preferably at least 75% of them) have more than 50% of their perimeter (for polygons) not in contact with any of the other elements of the structure. Thus, in a multilevel structure it is easy to identify geometrically and individually distinguish most of its basic component elements, presenting at least two levels of detail: that of the overall structure and that of the polygon or polyhedron elements which form it. Its name is precisely due to this characteristic and from the fact that the polygon or polyhedron can be included in a great variety of sizes. Additionally, several multilevel structures may be grouped and coupled electromagnetically to each other to form higher level structures. In a multilevel structure all the component elements are polygons with the same number of sides or polyhedron with the same number of faces. Naturally, this property is broken when several multilevel structures of different natures are grouped and electromagnetically coupled to form meta-structures of a higher level.

Its designation as multilevel antenna is precisely due to the fact that in the body of the antenna can be identified at least two levels of detail: that of the overall structure and that of the majority of the elements (polygons or polyhedrons) which make it up. This is achieved by ensuring that the area of contact or intersection (if it exists) between the majority of the elements forming the antenna is only a fraction of the perimeter or surrounding area of said polygons or polyhedrons.

A particular property of multilevel antennae is that their radioelectric behaviour can be similar in several frequency bands. Antenna input parameters (impedance and radiation pattern) remain similar for several frequency bands (that is, the antenna has the same level of matching or standing wave relationship in each different band), and often the antenna presents almost identical radiation diagrams at different frequencies. This is due precisely to the multilevel structure of the antenna, that is, to the fact that it remains possible to identify in the antenna the majority of basic elements (same type polygons or polyhedrons) which make it up. The number of frequency bands is proportional to the number of scales or sizes of the polygonal elements or similar sets in which they are grouped contained in the geometry of the main radiating element.

In addition to their multiband behaviour, multilevel structure antennae usually have a smaller than usual size as compared to other antennae of a simpler structure. (Such as those consisting of a single polygon or polyhedron). Additionally, its edge-rich and discontinuity-rich structure enhances the radiation process, relatively increasing the radiation resistance of the antenna and reducing the quality factor Q, i.e. increasing its bandwidth.

Thus, the main characteristic of multilevel antennae are the following:

A multilevel geometry comprising polygon or polyhedron of the same class, electromagnetically coupled and grouped to form a larger structure. In multilevel geometry most of these elements are clearly visible as their area of contact, intersection or interconnection (if these exist) with other elements is always less than 50% of their perimeter.

The radioelectric behaviour resulting from the geometry: multilevel antennae can present a multiband behaviour (identical or similar for several frequency bands) and/or operate at a reduced frequency, which allows reducing their size.

In specialized literature it is already possible to find descriptions of certain antennae designs which allow to cover a few bands. However, in these designs the multiband behaviour is achieved by grouping several single band antennae or by incorporating reactive elements in the antennae (lumped elements as inductors or capacitors or their integrated versions such as posts or notches) which force the apparition of new resonance frequencies. Multilevel antennae on the contrary base their behaviour on their particular geometry, offering a greater flexibility to the antenna designer as to the number of bands (proportional to the number of levels of detail), position, relative spacing and width, and thereby offer better and more varied characteristics for the final product.

A multilevel structure can be used in any known antenna configuration. As a non-limiting example can be cited: dipoles, monopoles, patch or microstrip antennae, coplanar antennae, reflector antennae, wound antennae or even antenna arrays. Manufacturing techniques are also not characteristic of multilevel antennae as the best-suited technique may be used for each structure or application. For example: printing on dielectric substrate by photolithography (printed circuit technique); dieing on metal plate, repulsion on dielectric, etc.

Further embodiments of the invention and particular combinations of features of the invention, are described in the attached claims.

The invention is obviously not limited to the specific embodiment(s) described herein, but also encompasses any variations that may be considered by any person skilled in the art (for example, as regards the choice of materials, dimensions, components, configuration, etc.), within the general scope of the invention as defined in the claims.

The invention claimed is:

1. A multiband antenna system for cellular base stations, comprising:

a common central support located substantially along a central axis of the multiband antenna system;

at least two multiband antenna arrays mounted on the common central support and radially spaced from the central axis of the multiband antenna system;

wherein each of the at least two multiband antenna arrays is longitudinally placed within an angular sector defined around said central axis;

wherein an angular spacing is defined between said angular sector;

a mechanical feature coupled to the common central support and to the at least two multiband antenna arrays to pivotally move each of the at least two multiband antenna arrays around said central axis within its corresponding angular sector, providing each of the at least two multiband antenna arrays with an adjustable azimuth coverage;

wherein each of the at least two multiband antenna arrays comprises a first set of radiating elements operating at a first frequency band and a second set of radiating elements operating at a second frequency band, wherein the second frequency band being higher than the first frequency band;

wherein the radiating elements are smaller than $\lambda/2$ or smaller than $\lambda/3$, wherein ($\lambda$) being a longest operating wavelength; and wherein a ratio between a central frequency of the second frequency band and a central frequency of the first frequency band is smaller than 2.

2. The multiband antenna system according to claim 1, wherein the multiband antenna system includes three multiband antenna arrays and wherein the angular spacing defined between said angular sectors is from about 0° to about 30°.

3. The multiband antenna system according to claim 1, wherein at least a portion of said at least one radiating element features a shape selected from the group consisting of space-filling curve, grid-dimension curve, multilevel, or fractal, and combinations thereof.

4. The multiband antenna system according to claim 1, wherein each said radiating element is a patch antenna having a perimeter of an element structure shaped with a curve of at least 5 segments, wherein said segments being smaller than the longest operating wavelength ($\lambda$) divided by 5.

5. The multiband antenna system according to claim 1, wherein in each of the at least two multiband antenna arrays, the first and the second set of radiating elements are arranged in two substantially parallel columns and in several substantially parallel rows, wherein in each column at least some elements of the first and second set of radiating elements are interlaced, wherein each radiating element is vertically and horizontally adjacent to respective radiating elements of the other set of radiating elements.

6. The multiband antenna system according to claim 1, wherein the first and the second set of radiating elements of each of the at least two multiband antenna arrays is aligned in a single column, wherein the radiating elements of the first and the second set are grouped together forming respectively a first and a second sub-arrays one on top of each other in a stacked arrangement, wherein a distance between a center to center of each sub-array is larger than one operating wavelength.

7. The multiband antenna system according to claim 1, wherein each of the at least two multiband antenna arrays comprises at least one phase-shifter device providing an adjustable electrical downtilt for each frequency band, the at least one phase-shifter having an electrical path of variable length.

8. The multiband antenna system according to claim 7, wherein the phase-shifter comprises a first transmission line electrically connected and slideably mounted on a second transmission line.

9. The multiband antenna system according to claim 1, wherein the multiband antenna system includes a substantially cylindrical radome of a dielectric material, said dielectric material being substantially transparent within the 1700-2700 MHz frequency range, the at least two multiband antenna arrays being housed within said radome.

10. The multiband antenna system according to claim 1, wherein the multiband antenna system is mounted on an elongated support of adjustable height.

11. The multiband antenna system according to claim 10, wherein the elongated support is formed by one or more modular support sections axially coupled.

12. The multiband antenna system according to claim 10, wherein the elongated support comprises a hinge, folding or retracting means, so that the support can be retracted or folded.

13. A dual-polarized multiband antenna array for cellular base station antennas, comprising:

a set of small dual-polarized radiating elements, said small dual-polarized radiating elements being smaller than one half of a longest operating wavelength of a first and a second frequency bands;

wherein the set of small dual-polarized radiating elements are dual-polarized patch antenna elements each comprising a first pair of feeding points combined with a first divider defining a first port of said dual-polarized patch antenna element and a second pair of feeding points combined with a second divider defining a second port of said dual-polarized patch antenna element;

wherein said first port provides a first polarization of each dual-polarized patch antenna element of the set of small dual-polarized radiating element and said second port provides a second polarization of each dual-polarized patch antenna element of the set of small dual-polarized radiating element, wherein the second polarization being substantially orthogonal to the first polarization;

wherein said antenna array operates at said first and second frequency bands within a 1700 MHz-2700 MHz frequency range, wherein the second frequency band being higher than the first frequency band;

wherein a ratio between a central frequency of the second frequency band and a central frequency of the first frequency band being smaller than 1.28;

wherein said dual-polarized multiband antenna array features a width smaller than one and a half times the longest operating wavelength of the first and second frequency bands;

wherein said set of small dual-polarized radiating elements include a first and second subset of elements, the first subset of elements operating at the first frequency band, the second subset of elements operating at the second frequency band, wherein the elements of the first and second frequency bands are spatially interlaced such that a spacing between any two elements of the first and second subset of elements is between ½ and ⅓ of an operating wavelength; and wherein at least a portion of the set of small dual-polarized radiating elements feature a shape selected from the group consisting of space-filling curve, grid-dimension curve, multilevel, fractal, and combinations thereof.

14. A multiband antenna array for cellular base station, comprising:

a first set of radiating elements;

a second set of radiating elements;

wherein said multiband antenna array is operable at a first frequency band and at a second frequency band, wherein the second frequency band being higher than the first frequency band;

wherein a ratio between a central frequency of the second frequency band and a central frequency of the first frequency band being smaller than 1.5;

wherein said first set of radiating elements operate at said first frequency band and said second set of radiating elements operate at said second frequency band;

wherein said first and second set of radiating elements being smaller than half a wavelength ($\lambda/2$) or smaller than $\lambda/3$ of a longest operating wavelength; and wherein said first and second set of radiating elements are arranged in two substantially parallel columns and in several substantially parallel rows, wherein in each column at least some elements of said first and second set of radiating elements are interlaced, wherein each radiating element is vertically and horizontally adjacent to respective radiating elements of the other set of radiating elements.

15. The multiband antenna array according to claim 14, wherein a horizontal spacing is defined between the radiating elements of the first and second set of frequency bands, wherein said horizontal spacing is between ½ and ⅓ of an operating wavelength ($\lambda$).

16. The multiband antenna array according to claim 14, wherein at least a portion of at least one radiating element in each of said first and second set of radiating elements features a shape selected from the group consisting of a space-filling curve, a grid-dimension curve, a multilevel or fractal and combinations thereof.

17. The multiband antenna array according to claim 14, wherein each radiating element is a patch antenna or a dipole antenna having a perimeter or at least a portion of a structure shaped with a curve of at least five segments, wherein said segments being smaller than the longest operating wavelength divided by 5.

18. The multiband antenna array according claim 14, wherein at least a portion of the multiband antenna array is defined by a curve having a box-counting dimension or grid dimension larger than 1.1, or 1.2, or 1.3.

19. The multiband antenna array according to claim 14, wherein the multiband antenna array comprises at least one phase-shifter providing a variable down-tilt for at least one frequency band.

20. The multiband antenna array according to claim 19, wherein the phase-shifter comprises a first transmission line slideably mounted on a second transmission line.

21. The multiband antenna array according to claim 20, wherein:

the first transmission line of the phase-shifter is on a first substrate and the second transmission line is on a second substrate;

wherein the first substrate is mounted onto the second substrate so that there is a region in which at least a portion of the first transmission line is in a projection of at least a portion of said second transmission line; and wherein said first substrate is operable to slide along a direction contained in a plane defined by said second substrate so that an extension of said region is varied.

22. The multiband antenna array according to claim 14, wherein a vertical spacing between said first and second set of radiating elements is less than one wavelength λ, or less than ¾ of λ, or less than ⅔ of λ at all frequencies of operation.

23. The multiband antenna array according to claim 14, wherein at least one of the first and second set of radiating elements is housed within a box-like ground plane.

24. The multiband antenna array according to claim 14, wherein at least one row of radiating elements has a discontinued ground-plane.

25. The multiband antenna array according to claim 14, wherein said first and second frequency bands are within the 1700 MHz-2700 MHz frequency range.

26. The multiband antenna array according to claim 14, wherein said multiband antenna array features a width smaller than two wavelengths, or one and a half times a longer operating wavelength, or 1.4λ, or 1.3λ, or less than 1λ for any of the operating bands.

27. The multiband antenna array according to claim 14, wherein the multiband antenna array comprises three antenna arrays, wherein the three antennas arrays are housed within a cylindrical radome.

28. The multiband antenna array according to claim 27, wherein three equal circular sectors are defined within said cylindrical radome, and wherein each antenna array is longitudinal placed within one of said three equal circular sectors, wherein an angular spacing between the three equal circular sectors is approximately 20°.

29. The multiband antenna array according to claim 28, wherein each antenna array comprises a ground plane, the ground plane defining a horizontal central portion and two side flanges, wherein each of the two side flanges defines an angle approximately equal to α, wherein $\alpha=30+A/2$, and wherein A is the angular spacing between two adjacent circular sectors.

30. The multiband antenna array according to claim 27, wherein three equal circular sectors are defined within said cylindrical radome, and wherein each antenna array is longitudinal placed within one of said three equal circular sectors, and wherein there is approximately no angular spacing between said three equal sectors.

31. A dual-band dual-polarized radiating system for a cellular base station, said dual-band dual-polarized radiating system comprising:

three antenna arrays radially displaced from a common mounting structure, wherein said three antenna arrays are symmetrically placed within three 120° angular sectors around said common mounting structure;

wherein an angular spacing between antenna arrays is provided to allow independent azimutal mechanical tilt for each sector;

wherein each of said three antenna arrays is composed by at least two sub-arrays operating at a first and at a second frequency band respectively, wherein said first and a second frequency bands are selected within the 1700 MHz-2700 MHz frequency range and wherein the second frequency band being higher than the first frequency band;

wherein a ratio between a central frequency of the second frequency band and a central frequency of the first frequency band being smaller than 1.28;

wherein said at least two sub-arrays operating at two different frequency bands are collinearly aligned one on top of each other in a stacked arrangement such that a distance between a center to center of each sub-array of the at least two sub-arrays is larger than one operating wavelength;

wherein each of said three antenna array features a width smaller than one and a half times a longest operating wavelength of the first and second frequency bands and a thickness smaller than half times the longest operating wavelength of the first and second frequency bands;

wherein each of said three arrays includes a set of compact radiating elements, wherein said compact radiating elements are smaller than one half of the longest operating wavelength, wherein at least one of said at least two sub-arrays operating at different frequencies includes a set of compact phase shifters for featuring variable electrical downtilt; and wherein at least one phase shifter feeds two radiating elements together through a power splitter network, wherein the whole dual-band dual-polarized radiating system is covered by a cylindrical radome of a dielectric material, said dielectric material being substantially transparent within the 1700-2700 MHz frequency range.

32. The dual-band polarized radiating system according to claim 31, wherein at least a portion of at least one radiating element features a shape selected from the group consisting of space-filling curve, grid-dimension curve, multilevel, fractal, and combinations thereof.

33. The dual-band dual-polarized radiating system according to claim 31, wherein the three antenna arrays are spaced in azimuth by an angle spacing ranging from about 0° to about 30°.

34. The dual-band dual-polarized radiating system according to claim 31, wherein said system is supported by a set multiple modular sections, said set multiple modular sections being mounted in a collinearly stacked fashion to form a longer tower section.

35. The dual-band dual-polarized radiating system according to claim 34, wherein the tower section supporting the radiating system comprises a hinge at its base, such that the whole tower section can be bent to install, upgrade or repair the radiating system.

36. A mobile telecommunication network comprising:

one or more dual-band dual-polarized radiating systems, each of the one or more dual-band dual-polarized radiating system comprising:

three antenna arrays radially displaced from a common mounting structure, wherein said three antenna arrays are symmetrically placed within three 120° angular sectors around said common mounting structure;

wherein an angular spacing between antenna arrays is provided to allow independent azimutal mechanical tilt for each sector;

wherein each of said three antenna arrays is composed by at least two sub-arrays operating at a first and at a second frequency band respectively, wherein said first and a second frequency bands are selected within the 1700 MHz-2700 MHz frequency range and wherein the second frequency band being higher than the first frequency band;

wherein a ratio between a central frequency of the second frequency band and a central frequency of the first frequency band being smaller than 1.28;

wherein said at least two sub-arrays operating at two different frequency bands are collinearly aligned one on top of each other in a stacked arrangement such that a distance between a center to center of each sub-array of the at least two sub-arrays is larger than one operating wavelength;

wherein each of said three antenna array features a width smaller than one and a half times a longest operating wavelength of the first and second frequency bands and a thickness smaller than half times the longest operating wavelength of the first and second frequency bands;

wherein each of said three arrays includes a set of compact radiating elements, wherein said compact radiating elements are smaller than one half of the longest operating wavelength, wherein at least one of said at least two sub-arrays operating at different frequencies includes a set of compact phase shifters for featuring variable electrical downtilt;

wherein at least one phase shifter feeds two radiating elements together through a power splitter network, wherein the whole dual-band dual-polarized radiating system is covered by a cylindrical radome of a dielectric material, said dielectric material being substantially transparent within the 1700-2700 MHz frequency range;

wherein said mobile telecommunication network co-allocates multiple services operating at least at two different frequency bands within the 1700 to 2700 MHz frequency range; and wherein a coverage and capacity of the network is independently adjusted at each of said at least two frequency bands by means of adjusting the phase shifters included in the sub-arrays of the one or more dual-band dual-polarized radiating systems.

37. A dual-band dual-polarized radiating system for a cellular base station, said dual-band dual-polarized radiating system comprising:

a central common mounting structure located substantially along a central axis of the dual-band dual-polarized radiating system;

at least three antenna arrays mounted on the central common mounting structure and radially displaced from the central common mounting structure, wherein said at least three antenna arrays are symmetrically placed within three 120° angular sectors around said central common mounting structure;

wherein each of the said three arrays comprises at least two sub-arrays adapted to operate at a first and at a second frequency band respectively, wherein the second frequency band being higher than the first frequency band;

wherein said first and second frequency bands are selected within the 1700 MHz-2700 MHz frequency range, a ratio between a central frequency of the second frequency band and a central frequency of the first frequency band being smaller than 2;

wherein each of the said at least three arrays includes a set of small radiating elements, wherein said small radiating elements are smaller than ($\lambda/2$) or smaller than ($\lambda/3$) of a longest operating wavelength ($\lambda$); and wherein a diameter of a circumference having a center on the central axis of the dual-band dual-polarized radiating system and enclosing the at least three antenna arrays is less than $2\lambda$ at the greater frequency of each band.

38. The dual-band dual-polarized radiating system according to claim 37, wherein the ratio between the largest and the smaller of said frequency bands is smaller than 1.6, 1.5, 1.4 or 1.3 wavelengths.

39. The dual-band dual-polarized radiating system according to claim 37, wherein said at least two sub-arrays operating at two different frequency bands are collinearly aligned one on top of each other in a stacked arrangement such that a distance between a center to center of each sub-array is larger than one operating wavelength.

40. The dual-band dual-polarized radiating system according to claim 37, wherein at least one of said sub-arrays operating at different frequencies includes a set of phase-shifters for featuring variable electrical downtilt, wherein at least one phase-shifter feeds two radiating elements together through a power splitter network.

41. The dual-band dual-polarized radiating system according to claim 40, wherein the phase-shifter comprises a first transmission line slideably mounted on a second transmission line.

42. The dual-band dual-polarized radiating system according to claim 40, wherein the phase-shifter comprises a first transmission line on a first substrate, and a second transmission line on a second substrate, wherein said first substrate is mounted onto said second substrate so that there is a region in which at least a portion of said first transmission line is in a projection of at least a portion of said second transmission line, and wherein said first substrate can slide along a direction contained in a plane defined by said second substrate so that an extension of said region is varied.

* * * * *